US012522967B2

(12) United States Patent
Bodine et al.

(10) Patent No.: US 12,522,967 B2
(45) Date of Patent: Jan. 13, 2026

(54) DEFLECTOR ASSEMBLY FOR LAUNDRY APPLIANCE

(71) Applicant: WHIRLPOOL CORPORATION, Benton Harbor, MI (US)

(72) Inventors: Darryl C. Bodine, St. Joseph, MI (US); Lorenzo Cordella, Lecce (IT)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 181 days.

(21) Appl. No.: 18/201,846

(22) Filed: May 25, 2023

(65) Prior Publication Data

US 2023/0383456 A1 Nov. 30, 2023

Related U.S. Application Data

(60) Provisional application No. 63/346,405, filed on May 27, 2022.

(51) Int. Cl.

| | |
|---|---|
| ***D06F 37/26*** | (2006.01) |
| ***D06F 39/14*** | (2006.01) |
| *D06F 23/02* | (2006.01) |

(52) U.S. Cl.
CPC ..... *D06F 37/266* (2013.01); *D06F 37/267* (2013.01); *D06F 39/14* (2013.01); *D06F 23/02* (2013.01)

(58) Field of Classification Search
CPC ..... D06F 37/266; D06F 37/267; D06F 39/14
See application file for complete search history.

(56) References Cited

U.S. PATENT DOCUMENTS

| | | | | |
|---|---|---|---|---|
| 6,256,823 | B1 | 7/2001 | Kronbetter et al. | |
| 7,357,006 | B2 | 4/2008 | Kim et al. | |
| 8,528,223 | B2 * | 9/2013 | Alisch | D06F 37/266 68/17 R |
| 9,732,459 | B2 | 8/2017 | Kim et al. | |
| 11,118,299 | B2 | 9/2021 | Holzen et al. | |
| 11,208,750 | B2 | 12/2021 | Bodine et al. | |
| 11,434,594 | B2 | 9/2022 | Bodine et al. | |
| 2005/0262879 | A1 | 12/2005 | Kim et al. | |
| 2013/0160215 | A1 * | 6/2013 | Anderson | D06F 39/02 8/137 |
| 2013/0160501 | A1 * | 6/2013 | Anderson | D06F 37/28 68/139 |
| 2013/0276322 | A1 * | 10/2013 | Anderson | D06F 58/04 34/130 |
| 2015/0181888 | A1 | 7/2015 | DeMasi et al. | |
| 2016/0145790 | A1 * | 5/2016 | Burgess | D06F 37/267 68/3 R |
| 2017/0030001 | A1 * | 2/2017 | Anderson | D06F 37/06 |
| 2018/0073182 | A1 * | 3/2018 | Burgess | D06F 37/267 |

(Continued)

*Primary Examiner* — Joseph L. Perrin
(74) *Attorney, Agent, or Firm* — Price Heneveld LLP

(57) ABSTRACT

A laundry appliance includes a cabinet with a front panel defining a front opening. A tub is disposed within the cabinet and has an access opening. The access opening is aligned with the front opening. A deflector has a rim and a chute. The rim is coupled to the front panel and extends along the front opening. The chute extends from the rim and toward the tub. A bellows is coupled to the deflector and the tub. The bellows extends along an inner edge of the rim and an interior edge of the chute and along the access opening of the tub. The deflector is disposed between the bellows and the front panel.

20 Claims, 23 Drawing Sheets

(56) References Cited

U.S. PATENT DOCUMENTS

| | | | | |
|---|---|---|---|---|
| 2020/0208324 | A1* | 7/2020 | Bodine | D06F 39/088 |
| 2020/0370222 | A1* | 11/2020 | Bodine | D06F 34/24 |
| 2020/0370233 | A1 | 11/2020 | Bodine et al. | |
| 2021/0017689 | A1* | 1/2021 | Burgess | D06F 37/267 |

* cited by examiner

DEFLECTOR ASSEMBLY FOR LAUNDRY APPLIANCE

CROSS-REFERENCE TO RELATED APPLICATION

This application claims priority to and the benefit under 35 U.S.C. § 119(e) of U.S. Provisional Application No. 63/346,405, filed on May 27, 2022, entitled "DEFLECTOR ASSEMBLY FOR LAUNDRY APPLIANCE," the disclosure to which is hereby incorporated herein by reference in its entirety.

BACKGROUND OF THE DISCLOSURE

The present disclosure generally relates to a deflector assembly, and more specifically, to a deflector assembly for a laundry appliance.

SUMMARY OF THE DISCLOSURE

According to at least one aspect of the present disclosure, a laundry appliance includes a cabinet with a front panel that defines a front opening. A tub is disposed within the cabinet and defines an access opening. The access opening is aligned with the front opening. A deflector includes a rim coupled to the front panel. The rim extends along the front opening. A chute is coupled to the rim. The chute extends from a lower portion of the rim and toward the tub. A bellows has a deflector-side edge coupled to the deflector and a tub-side edge coupled to the tub. The deflector-side edge of the bellows is coupled to an inner edge of the rim and an interior edge of the chute. The tub-side edge of the bellows is coupled to a lip defining the access opening of the tub. The deflector is disposed between the bellows and the front panel.

According to another aspect of the present disclosure, a laundry appliance includes a front panel that defines a front opening. A tub is disposed adjacent to the front panel. The tub defines an access opening. A deflector assembly extends between the front panel and the tub. The deflector assembly includes a deflector having a rim coupled to the front panel and a chute extending from the rim toward the tub. The deflector defines a deflector opening. A bellows is coupled to an innermost edge of the deflector and extends about the deflector opening. The bellows extends from the deflector to the tub. The deflector is disposed between the bellows and the front panel.

According to yet another aspect of the present disclosure, a deflector assembly includes a deflector that defines a deflector opening. The deflector includes a rim with a front plate and an insert that extends from the front plate. The insert extends along an upper portion of the rim about at least a portion of the deflector opening. A chute extends along a lower portion of the rim. A bellows is coupled to the upper portion of the rim and at least one of the lower portion of the rim under the chute and an interior edge of the chute.

These and other features, advantages, and objects of the present disclosure will be further understood and appreciated by those skilled in the art by reference to the following specification, claims, and appended drawings.

Figure 1:
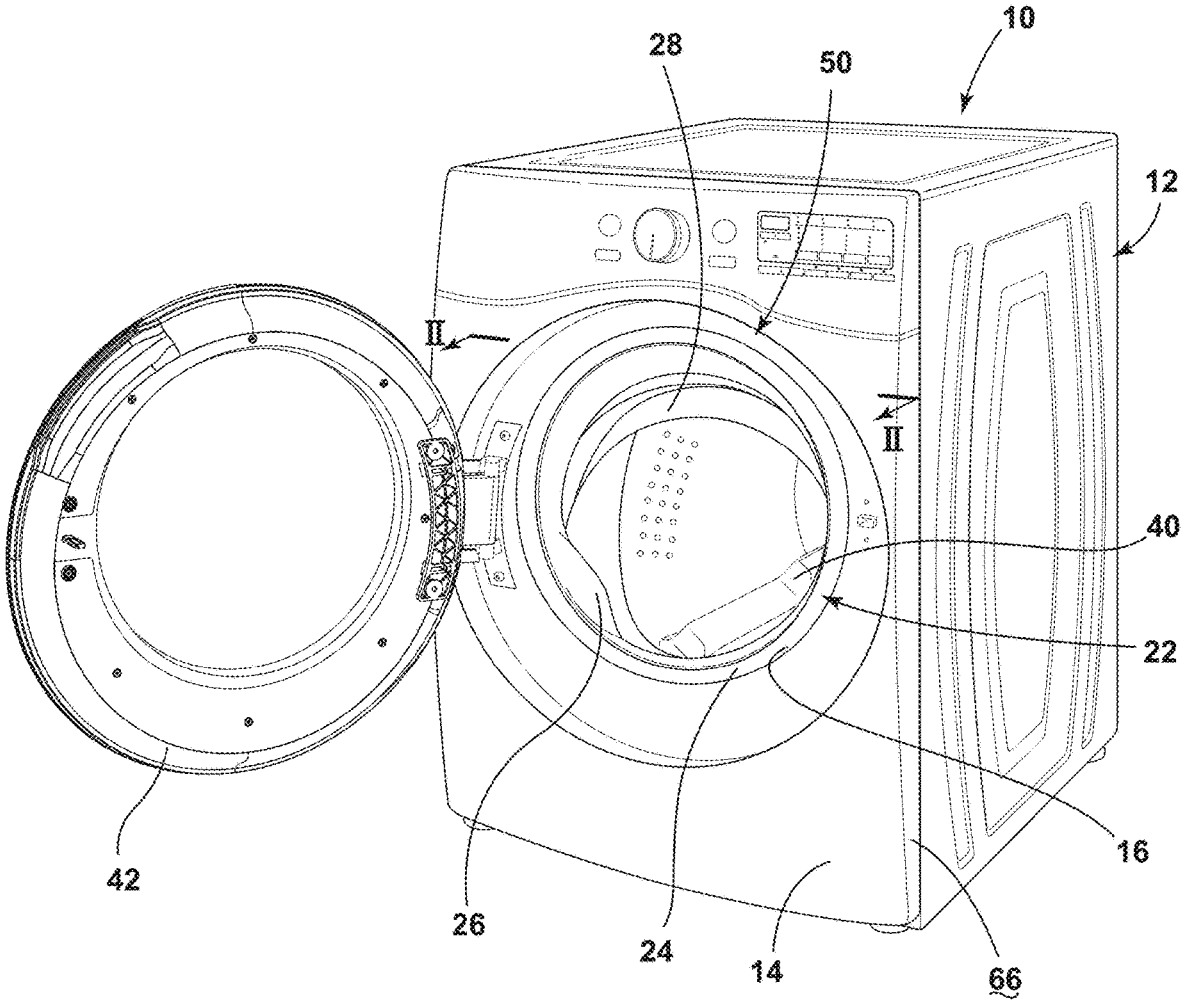
FIG. 1 is a front perspective view of a laundry appliance having a deflector assembly, according to the present disclosure.

The components in the figures are not necessarily to scale, emphasis instead being placed upon illustrating the principles described herein.

DETAILED DESCRIPTION

The present illustrated embodiments reside primarily in combinations of method steps and apparatus components related to a deflector assembly for a laundry appliance. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a . . . " does not, without more constraints, preclude the existence of additional identical elements in the process, method, article, or apparatus that comprises the element.

With reference to FIGS. 1-39, reference numeral 10 generally designates a laundry appliance that includes a cabinet 12 with a front panel 14 defining a front opening 16. A tub 18 is disposed within the cabinet 12 and defines an access opening 20. The access opening 20 is aligned with the front opening 16. A deflector 22 has a rim 24 and a chute 26. The rim 24 is coupled to the front panel 14 and extends along the front opening 16. The chute 26 extends from the rim 24 and toward the tub 18. A bellows 28 is coupled to the deflector 22 and the tub 18. The bellows 28 extends along an inner edge 30 of the rim 24 and an interior edge 32 of the chute 26 and along the access opening 20 of the tub 18. The deflector 22 is disposed between the bellows 28 and the front panel 14.

Figure 2:
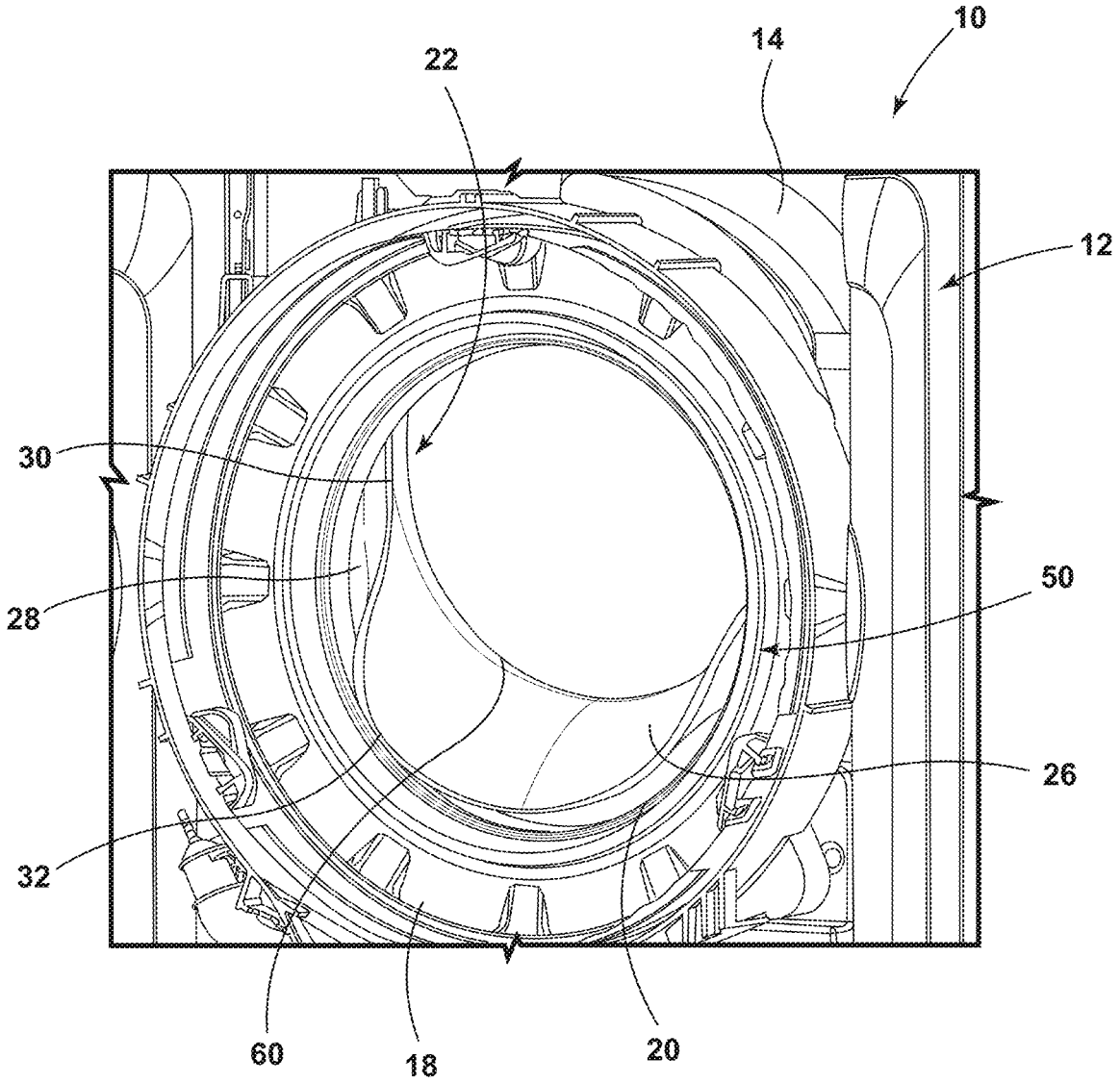
FIG. 2 is a partial cross-sectional rear perspective view of the laundry appliance of FIG. 1, taken along lines II-II, according to the present disclosure.
Figure 3:
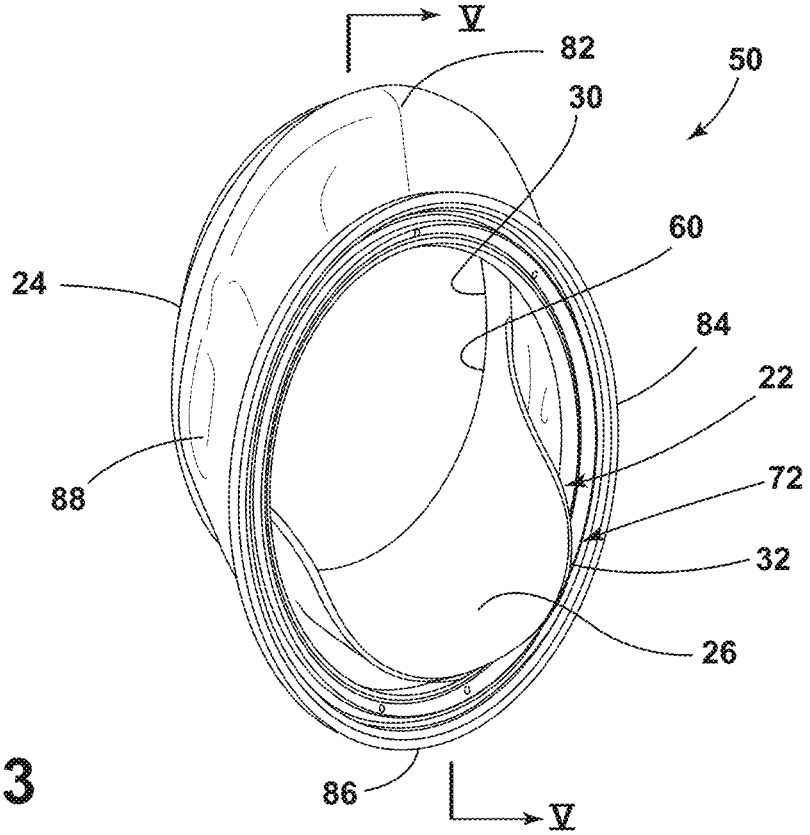
FIG. 3 is a rear perspective view of a deflector assembly, according to the present disclosure.
Figure 4:
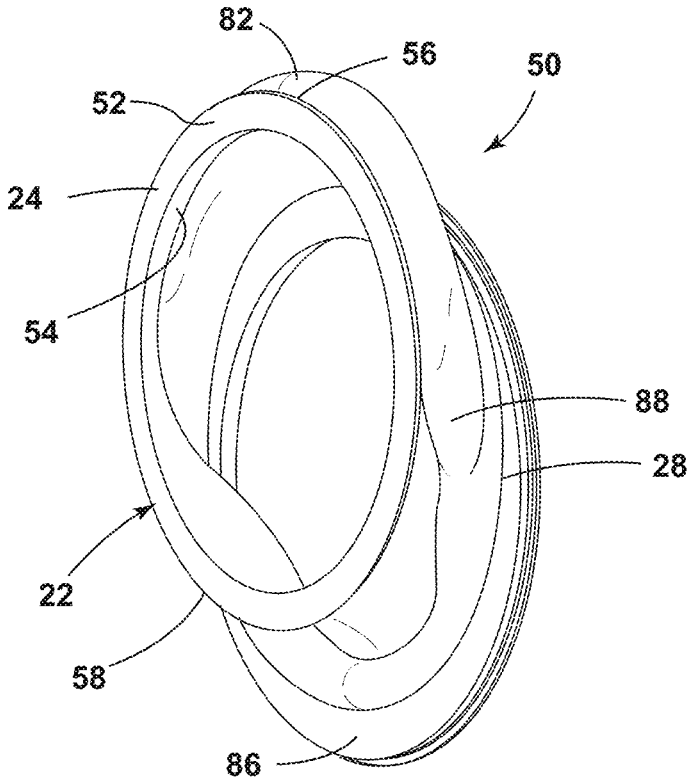
FIG. 4 is a front perspective view of the deflector assembly of FIG. 3, according to the present disclosure.

Referring to FIGS. 1 and 2, the laundry appliance 10 is illustrated as a front load washer with the front panel 14 of the cabinet 12 defining the front opening 16 for accessing a drum 40 within an interior of the laundry appliance 10. The position and size of the front opening 16 on the front panel 14 can provide increased access and/or more convenient access to the drum 40.

As illustrated in FIG. 1, the laundry appliance 10 includes a hinged, rotating door 42 operably coupled to the cabinet 12 for sealing the front opening 16 when the door 42 is in a closed position and for providing access to the drum 40 when the door 42 is in an opened position. The rotating door 42 in the illustrated configuration is generally flat or planar such that the door 42 does not include a conventional "fishbowl" projection. In various aspects, the laundry appliance 10 may include a sliding panel door 42, which may be flat, planar, or arcuate. In such examples, the sliding panel door 42 may slide rotationally or in a linear direction, where the sliding door panel 42 can move vertically or laterally relative to the front panel 14 between the opened and closed positions.

Referring still to FIGS. 1 and 2, the laundry appliance 10 includes a deflector assembly 50, which includes the deflector 22 and the bellows 28. The deflector 22 extends at least partially along a perimeter of the front opening 16 of the cabinet 12. Typically, the deflector 22 extends along the entire perimeter of the front opening 16. The rim 24 includes a front plate 52 that abuts the front panel 14 of the cabinet 12 and an insert 54 that extends through the front opening 16. The insert 54 generally extends along an upper portion 56 of the rim 24 between opposing sides of the chute 26 and may also extend along a lower portion 58 of the rim 24 between the front plate 52 and the chute 26. Alternatively, the chute 26 may extend from the front plate 52 without the insert 54 or may be integrally formed with the insert 54 to form a single component.

The chute 26 extends from the lower portion 58 of the rim 24, over the bellows 28, and toward the drum 40. The chute 26 forms an arcuate, "duckbill" extension that extends at an obtuse angle from the rim 24, forming a downwardly angled surface. The chute 26 generally extends about 180° along the rim 24. The deflector 22 forms a general ring shape, defining a deflector opening 60 that is generally concentric with the front opening 16 of the front panel 14. Accordingly, when the deflector 22 is coupled to the front panel 14, the front opening 16 is substantially free of the deflector 22, allowing access to the drum 40 through the front opening 16 and the deflector opening 60.

The deflector 22 is advantageous for protecting the bellows 28 from laundry contacting the bellows 28, which can result in premature wear of the bellows 28. The deflector 22 is also advantageous for deflecting laundry away from the bellows 28 and into the drum 40, as well as guiding fluid into the drum 40. The deflector assembly 50 can be used in conjunction with the sliding type door 42, the rotating type door 42, or other doors 42 for deflecting laundry away from the bellows 28.

Referring still to FIGS. 1 and 2, the bellows 28 of the deflector assembly 50 is coupled to the tub 18 along the perimeter of the access opening 20 and to the deflector 22. Accordingly, the bellows 28 extends between the tub 18 and the deflector 22, where the deflector 22 is disposed between the bellows 28 and the front panel 14. In this way, the bellows 28 may be free of a direct, mechanical attachment to the front panel 14.

The tub 18 is disposed within the cabinet 12 and defines the access opening 20, which generally aligns with the front opening 16. In various examples, the tub 18 and the drum 40 may be positioned at an angle with the cabinet 12. In such examples, the access opening 20 can be offset from the front opening 16. With the offset access opening 20, the bellows 28 can be an obliquely oriented bellows 28, configured to form an oblique cylinder or frusto-conical shape that defines a downward angle toward the drum 40 and between the deflector 22 and the access opening 20 of the offset tub 18. The bellows 28 is advantageous for retaining laundry within the tub 18 during the laundry cycle. Additionally, the bellows 28 can form a sloped surface to direct fluid, such as water, into the drum 40. The bellows 28 is typically configured as a flexible gasket that permits the tub 18 to move substantially independently of the cabinet 12.

Referring still to FIGS. 1 and 2, the deflector assembly 50 aligns with the front opening 16 such that the deflector opening 60 is generally concentric with the front opening 16, allowing access through the cabinet 12 and the deflector opening 60 to the drum 40 of the laundry appliance 10. The deflector 22 is typically constructed of plastic materials to provide a rigid deflecting feature within the laundry appliance 10. In certain aspects, the deflector 22 may be constructed of a clear, transparent, or semitransparent plastic, which assists in concealing or blending the deflector 22 into the bellows 28 or the laundry appliance 10. In additional or alternative examples, the deflector 22 may be constructed of an opaque or translucent plastic, which is advantageous for concealing attachments between the deflector 22 and the bellows 28.

While the deflector 22 of the deflector assembly 50 is rigid, the bellows 28 is constructed of an elastomeric material, such as rubber or silicone. In this way, the deflector assembly 50 provides an integrated component that includes both the rigid, plastic deflector 22 coupled to and/or integrally formed with the elastomeric bellows 28.

Referring to FIGS. 3-35, the deflector assembly 50 may have a variety of configurations, which often depends on the shape of the deflector 22 and/or how the bellows 28 couples to the deflector 22. Accordingly, the bellows 28 defines multiple cross-sections at different locations around the deflector 22. Each deflector assembly 50 provides the deflector 22 and the bellows 28, where the bellows 28 is coupled to the tub 18 and the deflector 22. This allows the deflector assembly 50 to be installed in the laundry appliance 10 as a single unit. Moreover, the deflector assemblies 50 utilize less material for the bellows 28, while still providing sufficient material for movement of the tub 18, which results in a more efficient manufacturing process.

Figure 5:
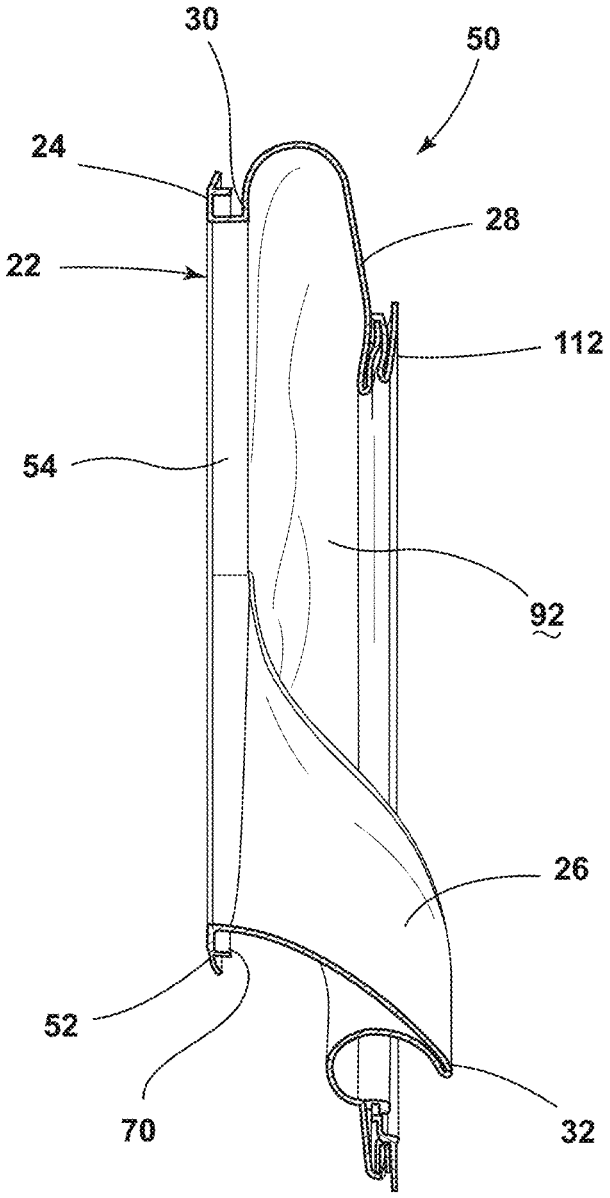
FIG. 5 is a cross-sectional view of the bellows assembly of FIG. 3, taken along lines V-V, according to the present disclosure.
Figure 6:
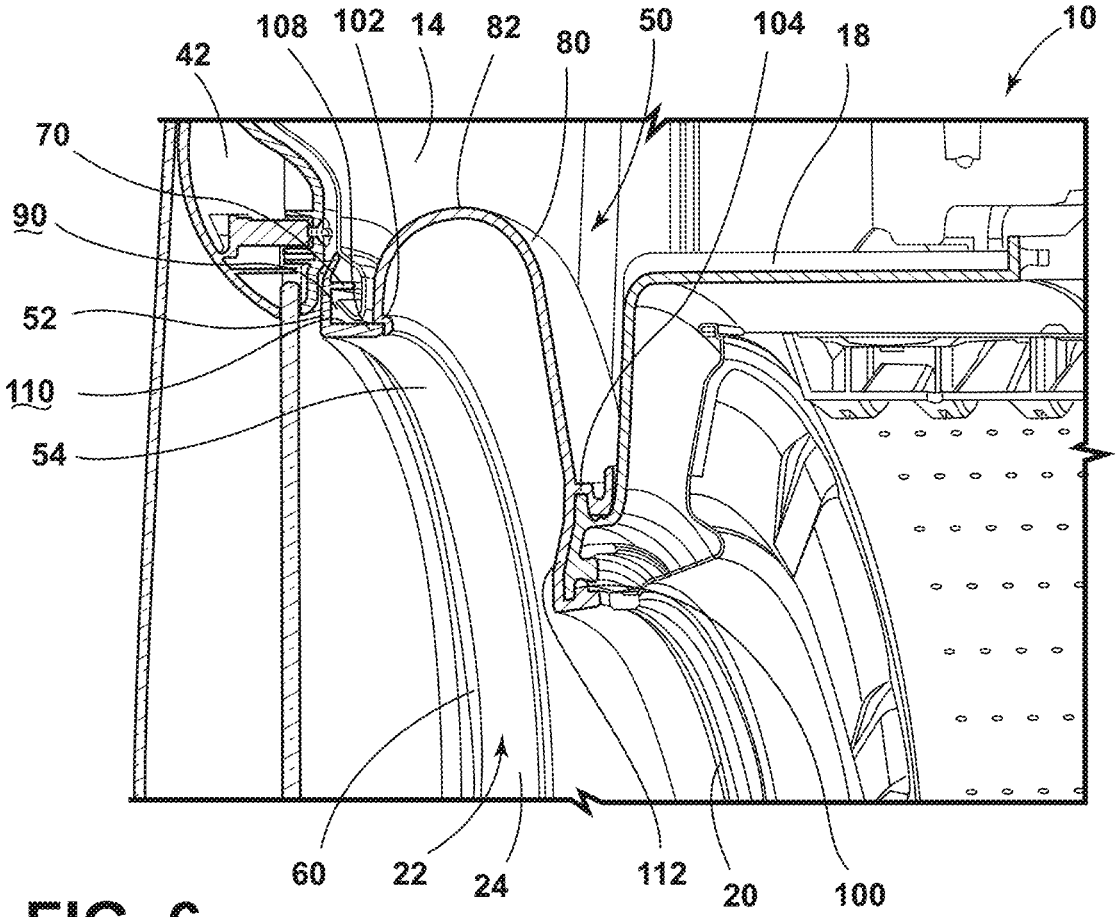
FIG. 6 is a partial cross-sectional, side perspective view of a laundry appliance at a 12 o'clock position of the deflector assembly of FIG. 3 installed in the laundry appliance, according to the present disclosure.

Referring again to FIGS. 3-8, the rim 24 includes the front plate 52 that abuts a front surface 66 of the cabinet 12 and the insert 54 that extends through the front opening 16. As illustrated in FIGS. 5 and 6, the insert 54 extends generally perpendicular to the front plate 52. The rim 24 also includes an annular projection 70, extending from the front plate 52 of the rim 24. The annular projection 70 typically extends 360° along the rim 24 and under the chute 26. The insert 54 and the annular projection 70 extend parallel with one another at least along the upper portion 56 of the rim 24. The annular projection 70 may be utilized for coupling the deflector 22 to the cabinet 12.

The insert 54 includes the inner edge 30 of the rim 24, and the chute 26 includes the interior edge 32. The inner edge 30 of the rim 24 and the interior edge 32 of the chute 26 collectively form an innermost edge 72 of the deflector 22. At the upper portion 56 of the deflector 22, the bellows 28 is coupled to the inner edge 30 of the insert 54, and at the lower portion 58 of the deflector 22 the bellows 28 is coupled to the interior edge 32 of the chute 26. Accordingly, the bellows 28 is coupled to the innermost edge 72 of the deflector 22, extending 360° around the deflector opening 60.

The bellows 28 defines a primary fold 80, which can extend partially beyond the innermost edge 72 of the deflector 22 and toward the front panel 14. However, as illustrated, the bellows 28 does not extend entirely to the front panel 14. This configuration utilizes less material for the bellows 28 by coupling the bellows 28 to the innermost edge 72 of the deflector 22 rather than coupling to the front panel 14 like conventional bellows assemblies.

The innermost edge 72 of the deflector 22 is disposed at different distances from the tub 18 at different locations around the deflector 22 based on the configuration of the deflector 22 with the chute 26 extending further from an inner surface 90 of the rim 24 compared to the insert 54, as well as the angled orientation of the tub 18. Accordingly, the bellows 28, extending between the deflector 22 and the tub 18 defines different shapes at different locations. For example, the bellows 28 defines a different shape at each of a 12 o'clock position 82 of the bellows 28, a 3 o'clock position 84 of the bellows 28, a 6 o'clock position 86 of the bellows 28, and a 9 o'clock position 88 of the bellows 28. It is contemplated that the 3 o'clock position 84 of the bellows 28 and the 9 o'clock position 88 of the bellows 28 are mirror images of one another. Between these four positions 82, 84, 86, 88, the bellows 28 gradually changes shape.

Each shape is configured to allow movement of the tub 18, promote fluid flowing along and from an inner surface 92 of the bellows 28 and toward the tub 18, and minimize items (such as laundry) and fluid being trapped on the bellows 28. Generally, the shape of the bellows 28 allows for a predefined amount of movement for the tub 18 in all directions, which may be about 25 mm of movement. Further, at each position of the bellows 28, the bellows 28 has the primary fold 80 that defines a general "U" shape. The U-shaped bellows 28 is advantageous for utilizing less materials to construct the bellows 28, as well as preventing items and fluid from being caught within the bellows 28.

As illustrated in FIG. 6, at the 12 o'clock position 82 of the bellows 28, the bellows 28 extends from the inner edge 30 of the insert 54 of the rim 24 of the deflector 22 to a lip 100 of the tub 18 that extends around the access opening 20. A deflector-side edge 102 of the bellows 28 is coupled to the inner edge 30 of the rim 24, and a tub-side edge 104 of the bellows 28 is coupled to the tub 18. The deflector-side edge 102 of the bellows 28 defines a notch 108 that fits the inner edge 30 of the rim 24. The deflector-side edge 102 is coupled to the inner edge 30, and an outer surface 110 of the insert 54 is adjacent to the inner edge 30. The bellows 28 extends vertically from the engagement with the deflector 22 away from the deflector opening 60, defines the inverted U-shaped primary fold 80, and extends below the deflector-side edge 102 to couple to the tub 18. Based on the offset configuration of the tub 18, the deflector-side edge 102 of the bellows 28 is vertically higher than the tub-side edge 104 of the bellows 28, forming a lopsided "U" or cane-shape at the 12 o'clock position 82.

The tub-side edge 104 of the bellows 28 defines a receiving portion 112. The receiving portion 112 is configured to receive the lip 100 of the tub 18, forming an interference or form fit about the lip 100. The bellows 28 extends around the lip 100 and partially through the access opening 20 to couple to the tub 18.

Figure 7:
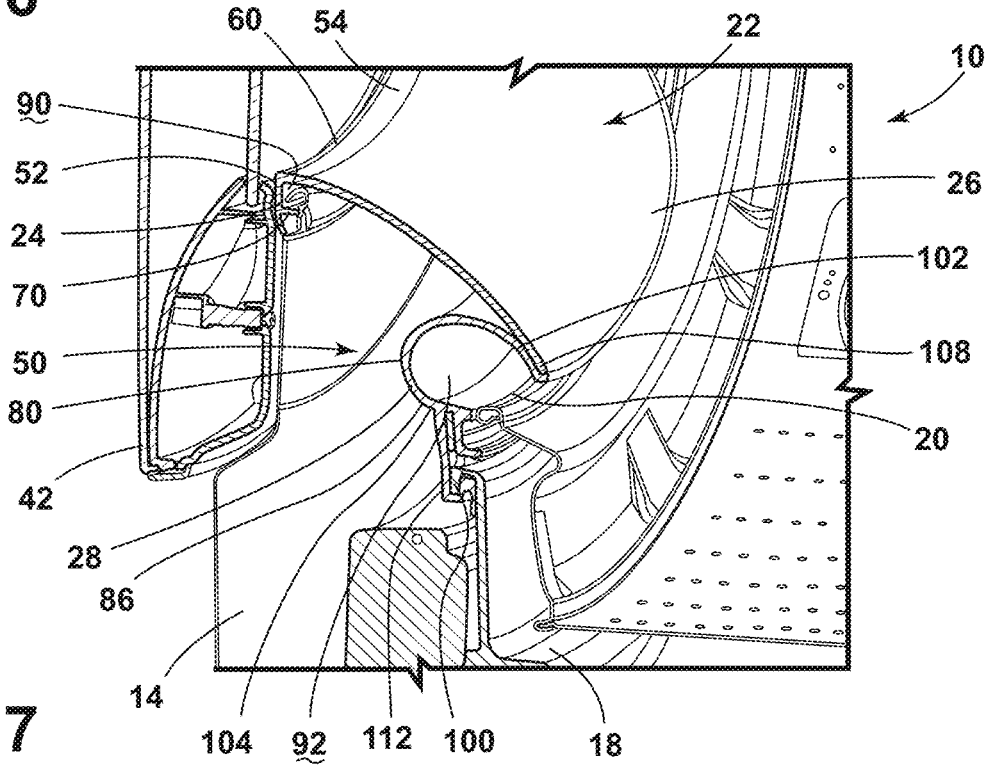
FIG. 7 is a partial cross-sectional, side perspective view of a laundry appliance at a 6 o'clock position of the deflector assembly of FIG. 3 installed in the laundry appliance, according to the present disclosure.

As illustrated in FIG. 7, at the 6 o'clock position 86 of the bellows 28, the deflector-side edge 102 of the bellows 28 is coupled to the interior edge 32 of the chute 26. Similar to the 12 o'clock position 82 (FIG. 6), the deflector-side edge 102 of the bellows 28 at the 6 o'clock position 86 defines the notch 108 to receive the interior edge 32 of the chute 26. The bellows 28 extends partially along a lower surface 114 of the chute 26, forms the U-shaped primary fold 80, and couples to the tub 18. The U-shape at the 6 o'clock position 86 is more compact and is slanted, having one side proximate to the chute 26 being longer and defining a greater curve than the opposing side that couples to the tub 18. Moreover, based on the position of the chute 26 and the tub 18, the "U" shape of the primary fold 80 at the 6 o'clock position 86 may be sideways, rotated about 90° relative to the "U" shape at the 12 o'clock position 84. Accordingly, the primary fold 80 at the 6 o'clock position 86 may also be referred to as a "C" shape. Additionally, as the chute 26 generally extends through the access opening 20 of the tub 18, the bellows 28 also extends partially through the access opening 20 to couple to the deflector 22.

Based on the configuration of the primary fold 80, the inner surface 92 of the bellows 28 at the tub-side edge 104 is generally angled downward or horizontally at the 6 o'clock position 86. This orientation of the bellows 28 where the bellows 28 couples to the tub 18 promotes fluid flowing off the bellows 28 into the tub 18 or the drum 40 (FIG. 1), as well as minimizes fluid entrapment on the bellows 28 at the 6 o'clock position 86. Fluid typically flows along the inner surface 92 of the bellows 28 toward the 6 o'clock position 86 due to gravitational forces. The U-shape at the 6 o'clock position 86 is advantageous for minimizing fluid and items from being retained on the bellows 28 at this lowermost position.

Figure 8:
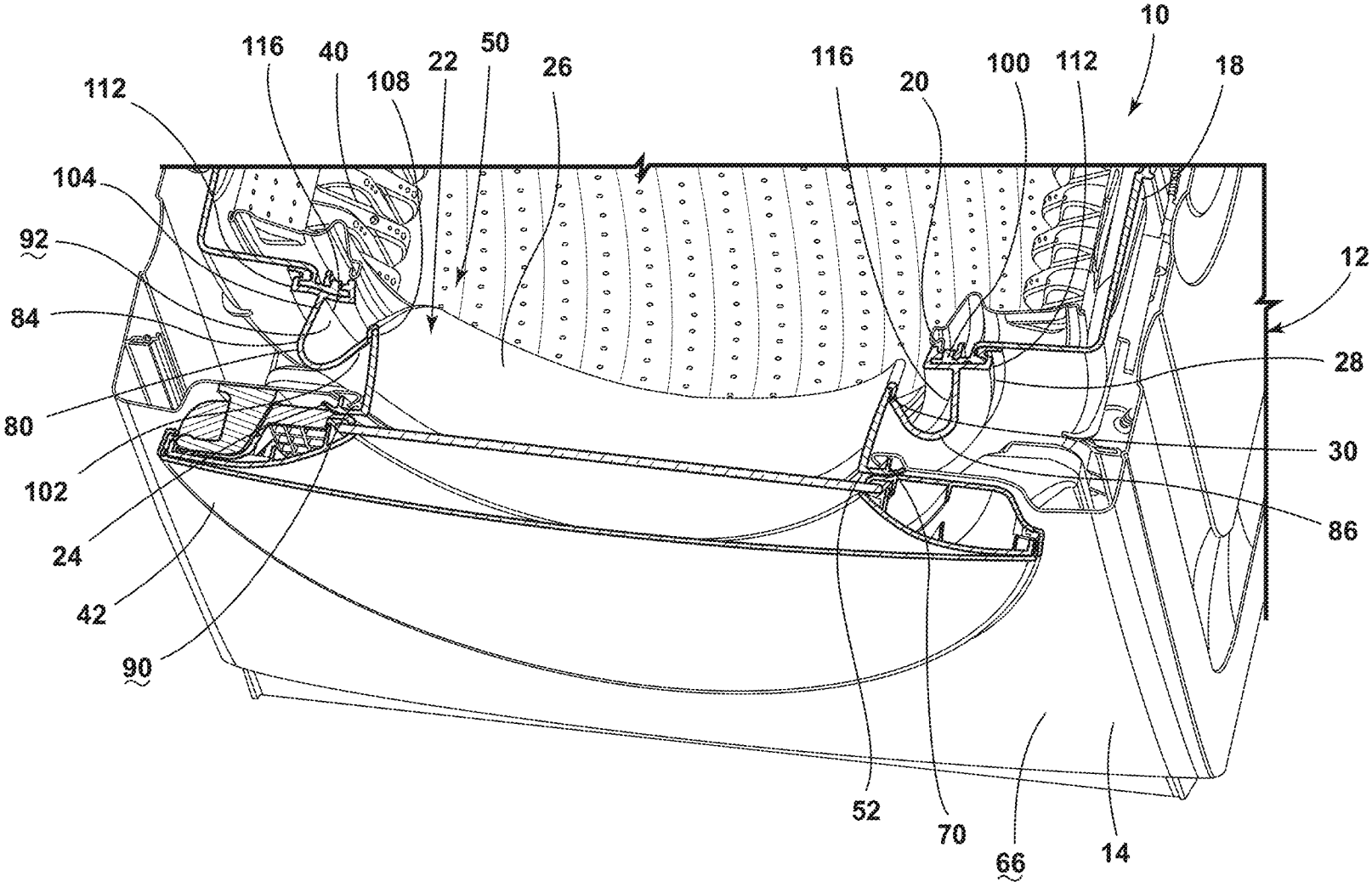
FIG. 8 is a partial cross-sectional, top perspective view of a laundry appliance at a 3 o'clock position and a 9 o'clock position of the deflector assembly of FIG. 3 installed in the laundry appliance, according to the present disclosure.
Figure 9:
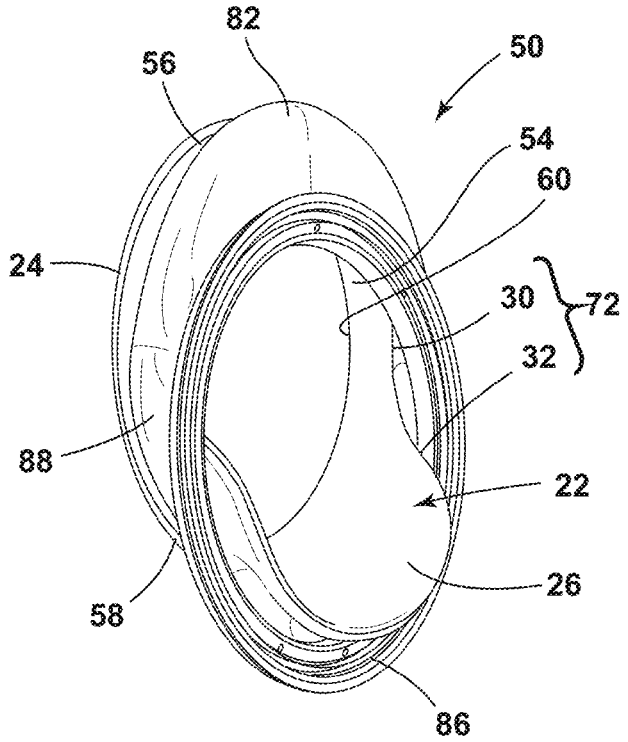
FIG. 9 is a rear perspective view of a deflector assembly, according to the present disclosure.
Figure 10:
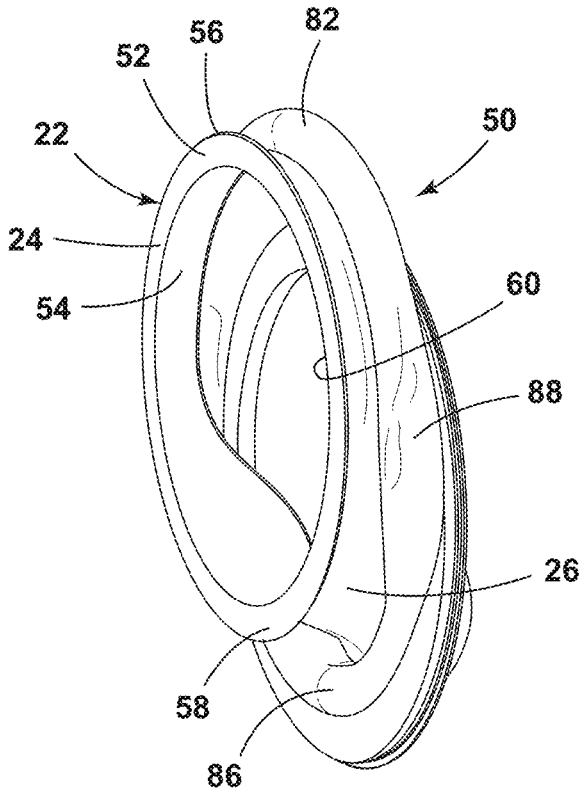
FIG. 10 is a front perspective view of the deflector assembly of FIG. 9, according to the present disclosure.

As illustrated in FIG. 8, the 3 o'clock position 84 and the 9 o'clock position 88 of the bellows 28 each define a different U-shape compared to the 12 o'clock position 82 illustrated in FIG. 6 and the 6 o'clock position 86 illustrated in FIG. 7. The 3 o'clock position 84 and the 9 o'clock position 88 may be defined at the rim 24, the chute 26, or an intersection between the two based on the configuration of the deflector 22.

At the 3 o'clock position 84 and the 9 o'clock position 88, the bellows 28 defines a wider "U" shape, with the primary fold 80 extending at an obtuse angle relative to the interior edge 32 of the chute 26, extending along the lower surface 114 of the chute 26. The deflector-side edge 102 of the bellows 28 defines the notch 108 to receive the deflector 22, and the bellows 28 extends toward the front panel 14. The bellows 28 then extends toward a rear of the laundry appliance 10 and slightly toward the deflector 22 to couple to the tub 18. In this way, the bellows 28 forms inwardly angled "U" shapes between the deflector 22 and the tub 18. The bellows 28 provides a smooth, angled surface for promoting fluid along the bellows 28 toward the 6 o'clock position 86.

Additionally, the receiving portion 112 of the bellows 28 defines a crease 116 with the inner surface 92. However, based on the generally vertical orientation of the crease 116 at the 3 o'clock position 84 and the 9 o'clock position 88, fluid does not typically become entrapped in the bellows 28 at these locations.

In various examples, the bellows 28 may include ripples, ridges, or grooves, which promote the flow of fluid and minimize fluid entrapment on the bellows 28. In such examples, the ridges extend along the inner surface 92 in the primary fold 80, generally parallel to the deflector-side and tub-side edges 102, 104 of the bellows 28 to promote fluid flow along the inner surface 92.

Referring again to FIGS. 3-8, the bellows 28 defines the notch 108 to receive the innermost edge 72 of the deflector 22. The bellows 28 extends from the innermost edge 72 and along the outer surface 110 of the rim 24 and the lower surface 114 of the deflector 22 adjacent to the innermost edge 72. The bellows 28 is illustrated as generally being molded onto or over the innermost edge 72 of the deflector 22. It is contemplated that coupling features, such as fasteners, clips, splines, or other features, for coupling or securing the bellows 28 to the deflector 22 may also be utilized without departing from the teachings herein.

Referring again to FIGS. 9-13, the bellows 28 is illustrated as coupled to the inner edge 30 of the rim 24 along the upper portion 56 of the deflector 22 and the interior edge 32 of the chute 26 along the lower portion 58 of the deflector 22. The innermost edge 72 of the deflector 22 defines a groove 120 that extends along the entirety of the deflector 22 and is configured to receive the deflector-side edge 102 of the bellows 28. In this way, the bellows 28 is partially inserted into the deflector 22. Based on this engagement, the shape of the bellows 28 at each of the positions 82, 84, 86, 88 is slightly different having the U-shaped primary fold 80 and, in at least some locations, a secondary fold 122 to orient the deflector-side edge 102 to be inserted into the groove 120.

Figure 11:
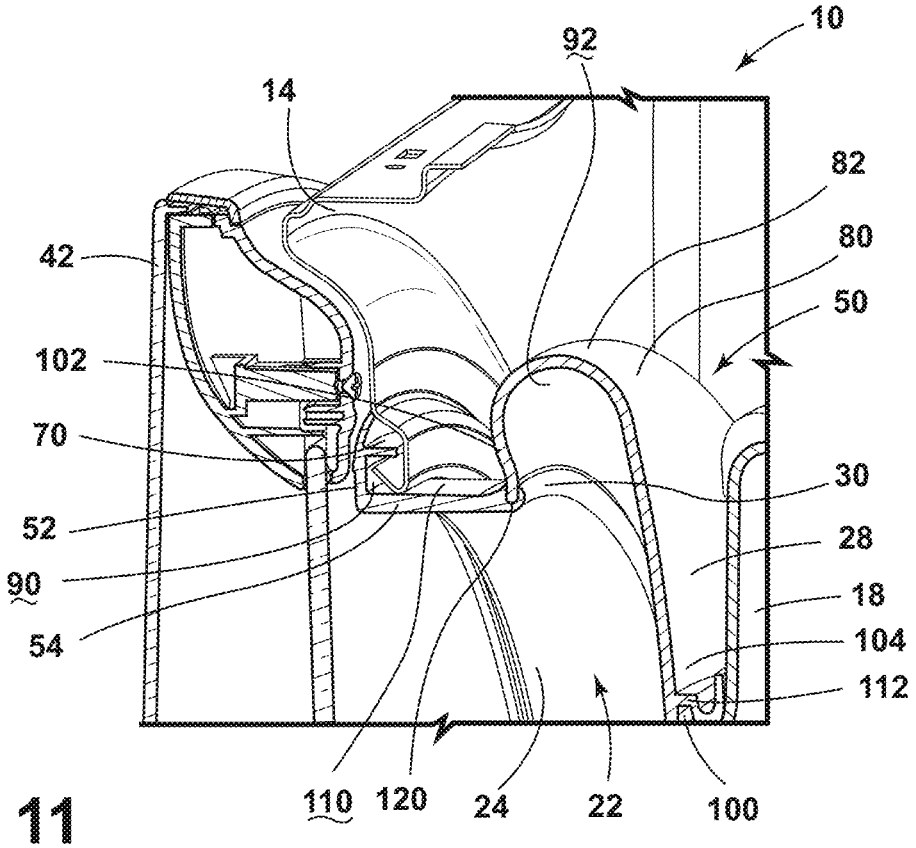
FIG. 11 is a partial cross-sectional, side perspective view of a laundry appliance at a 12 o'clock position of the deflector assembly of FIG. 9 installed in the laundry appliance, according to the present disclosure.

As illustrated in FIG. 11, the insert 54 of the deflector 22 extends horizontally through the front opening 16 of the cabinet 12. The inner edge 30 of the insert 54 is thickened to define the groove 120, which is oriented outward, away from the deflector opening 60. The deflector-side edge 102 of the bellows 28 is inserted into the groove 120. At the 12 o'clock position 82, the primary fold 80 is slightly narrower due to the vertical insertion of the deflector-side edge 102 of the bellows 28 into the groove 120 of the deflector 22.

The bellows 28 extends vertically away from the deflector opening 60 and slightly toward the front panel 14, defining the primary fold 80. Additionally, the deflector-side edge 102 of the bellows 28 is vertically offset from the tub-side edge 104 of the bellows 28 based on the offset position of the tub 13. At the 12 o'clock position 82, the bellows 28 defines a narrower, slightly angled cane shape, which can be similar to the "U" shape, but having one side that is longer than the other to account for the vertical offset.

Figure 12:
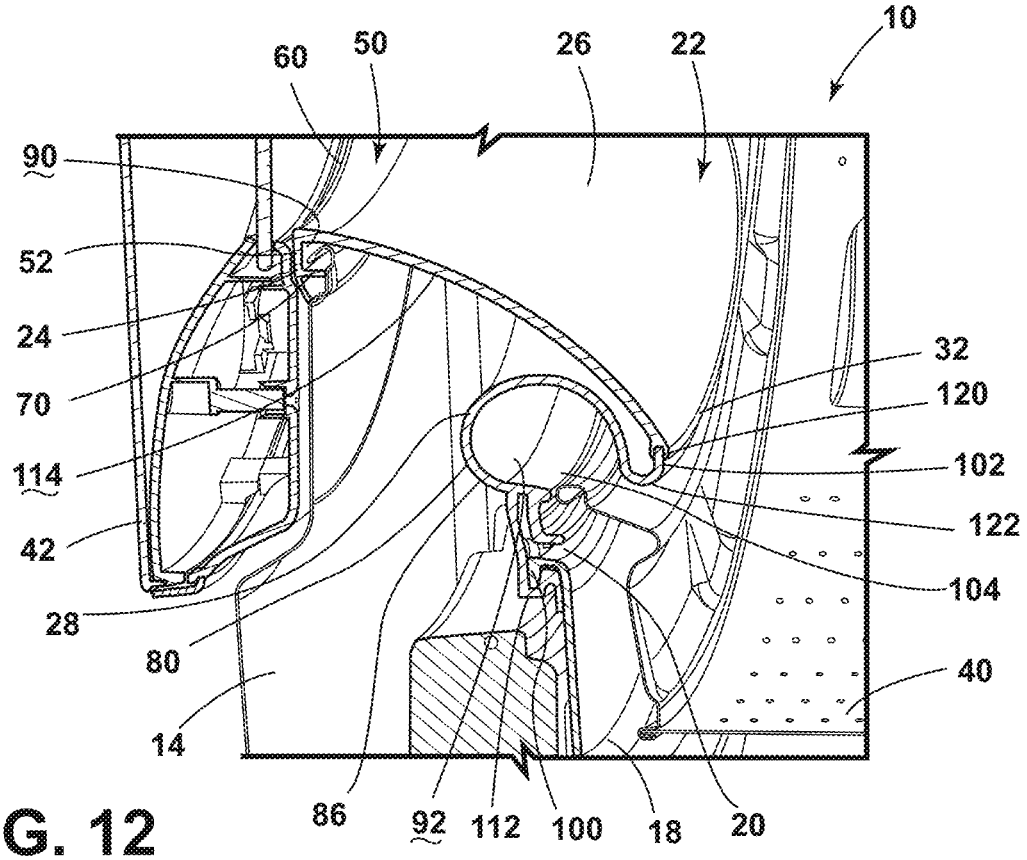
FIG. 12 is a partial cross-sectional, side perspective view of a laundry appliance at a 6 o'clock position of the deflector assembly of FIG. 9 installed in the laundry appliance, according to the present disclosure.

Referring to FIG. 12, at the 6 o'clock position 86, the groove 120 defined in the chute 26 is oriented outward from the deflector opening 60, opening downward. The bellows 28 is inserted vertically into the groove 120, which causes the secondary fold 122 of the bellows 28. The bellows 28 extends from the smaller, secondary fold 122 to the larger primary fold 80. The larger primary fold 80 is U-shaped, having the side by the deflector 22 with a greater curve than the side that is coupled to the tub 18. The primary fold 80 has a looser or more gentle curve, while the secondary fold 122 has a tighter or sharper curve. The secondary fold 122 is caused by the angle of the deflector-side edge 102 of the bellows 28 being inserted into the groove 120 of the deflector 22. Further, the primary and secondary folds 80, 122 are formed from the deflector-side edge 102 of the bellows 28 extending into the tub 18 to couple to the deflector 22.

The secondary fold 122 of the bellows 28 typically curves in a different or opposing direction relative to the primary fold 80. In this way, the primary fold 80 opens toward the tub 18, while the secondary fold 122, which can transition from the primary fold 80, opens toward the deflector 22. The secondary fold 122 is sufficient to allow the insertion of the bellows 28 into the deflector 22 but does not define a substantial fold or curve. Further, the secondary fold 122 generally does not define an area on the inner surface 92 of the bellows 28 where fluid can be trapped.

The primary fold 80 and the tub-side edge 104 of the bellows 28 forms the smooth surface that is oriented at a slight downward angle or horizontally to promote the fluid being directed into the tub 18. In certain aspects, at select positions of the bellows 28, the bellows 28 may include additional folds to define a transition between the primary fold 80 and the secondary fold 122. The incorporation of additional folds can be used to increase the range of motion that the bellows 28 can accommodate relative to the tub 18 and the cabinet 12.

Figure 13:
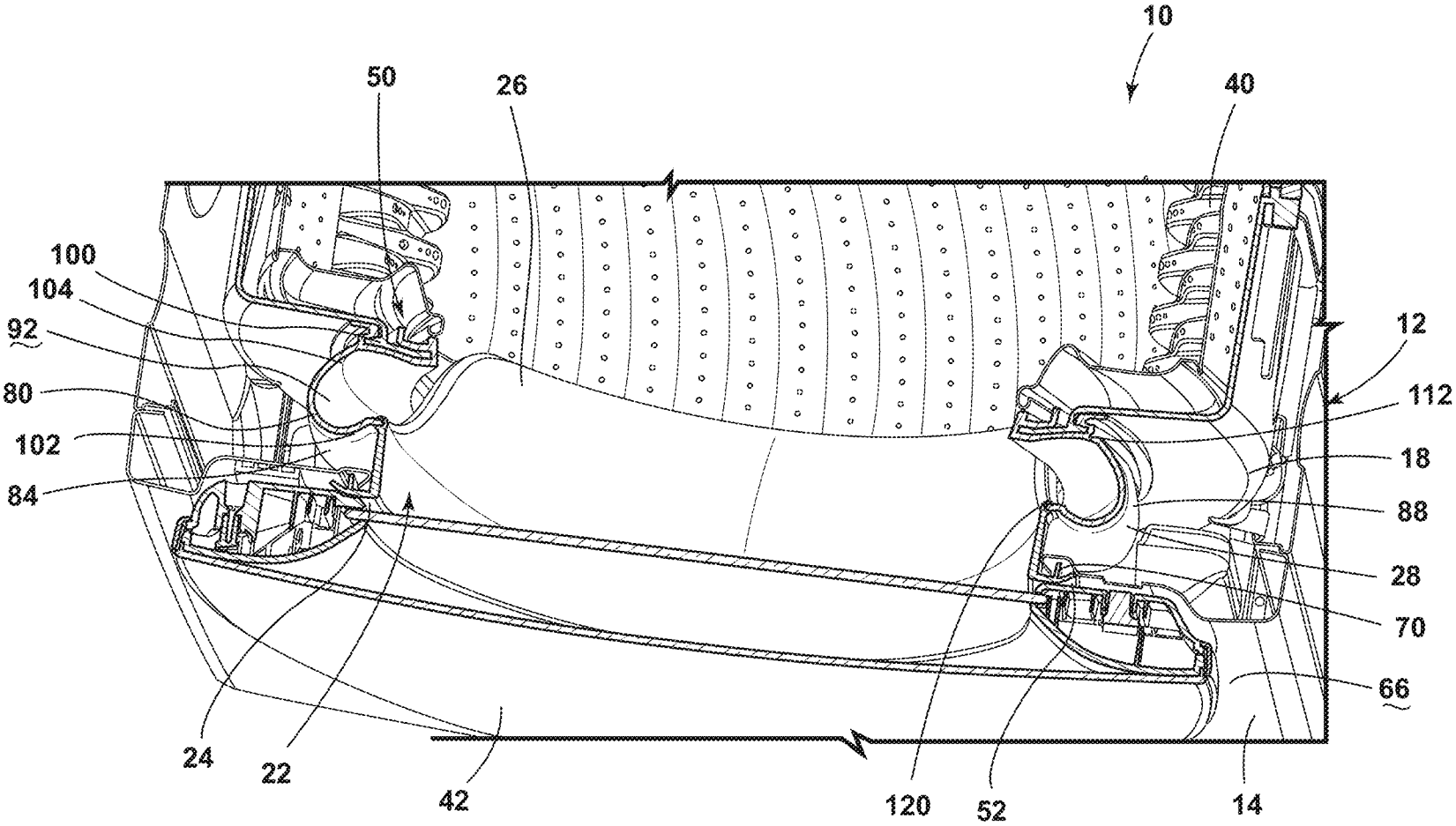
FIG. 13 is a partial cross-sectional, top perspective view of a laundry appliance at a 3 o'clock position and a 9 o'clock position of the deflector assembly of FIG. 9 installed in the laundry appliance, according to the present disclosure.
Figure 14:
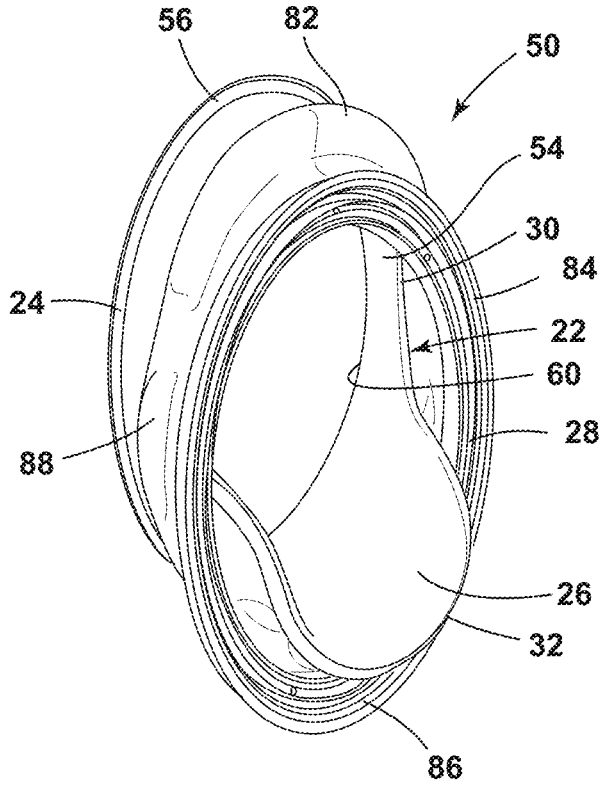
FIG. 14 is a rear perspective view of a deflector assembly, according to the present disclosure.
Figure 15:
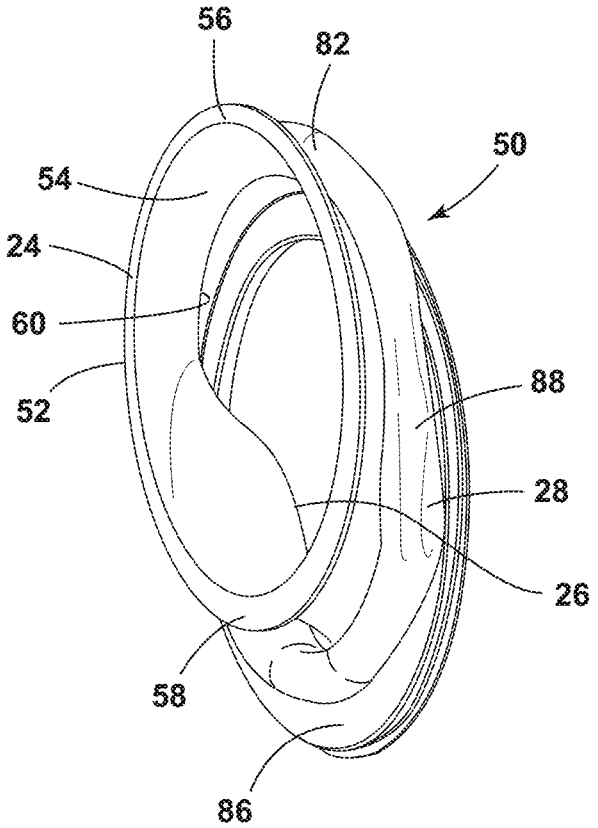
FIG. 15 is a front perspective view of the deflector assembly of FIG. 14, according to the present disclosure.

As illustrated in FIG. 13, at the 3 o'clock position 84 and the 9 o'clock position 88 of the bellows 28, the grooves 120 on the sides of the deflector 22 open in opposing directions, away from one another (e.g., toward a left side at the 3 o'clock position 84 and toward a right side at the 9 o'clock position 88). The deflector-side edge 102 of the bellows 28 is inserted into the groove 120 and extends away from the deflector 22, slightly toward the front panel 14 of the laundry appliance 10. The primary fold 80 of the bellows 28 is oriented at an angle, slightly toward the drum 40 as the side of the bellows 28 that is coupled to the deflector 22 is slightly shorter than the side that couples to the tub 18. In this way, the primary fold 80 extends slightly outward from the deflector 22 and toward the front panel 14, opening in a direction toward a center of the tub 18.

Referring again to FIGS. 9-13, the deflector-side edge 102 of the bellows 28 is inserted into the groove 120 defined along the innermost edge 72 of the deflector 22. The bellows 28 may be molded into the groove 120. Additionally or alternatively, coupling features may be utilized to secure the bellows 28 into the groove 120. The receiving portion 112 of the bellows 28 on the tub-side edge 104 extends around the lip 100 of the tub 18 to couple the bellows 28 to the tub 18.

Referring again to FIGS. 3-13, as well as to FIGS. 14-19, the shape of the bellows 28 may also be affected by the shape of the deflector 22. In the configurations illustrated in FIGS. 3-13, the insert 54 of the rim 24 of the deflector 22 extends horizontally through the front opening 16 of the cabinet 12 and perpendicular to the front plate 52. In this way, a size of the deflector opening 60 along the upper portion 56 of the rim 24 is substantially the same from the inner edge 30 of the insert 54 to where the insert 54 couples to the front plate 52 of the rim 24.

In comparison, as illustrated in FIGS. 14-19, the insert 54 of the rim 24 of the deflector 22 extends at an oblique angle from the front plate 52 and into the interior of the cabinet 12. Typically, the insert 54 extends into the deflector opening 60, such that the insert 54 of the rim 24 forms a portion of a frusto-conical shape. The deflector opening 60 is narrowed along the upper portion 56 by the insert 54. The insert 54 extends toward the lip 100 of the tub 18. The angled or slanted insert 54 narrows the gap between the inner edge 30 of the rim 24 and the tub 18.

Figure 16:
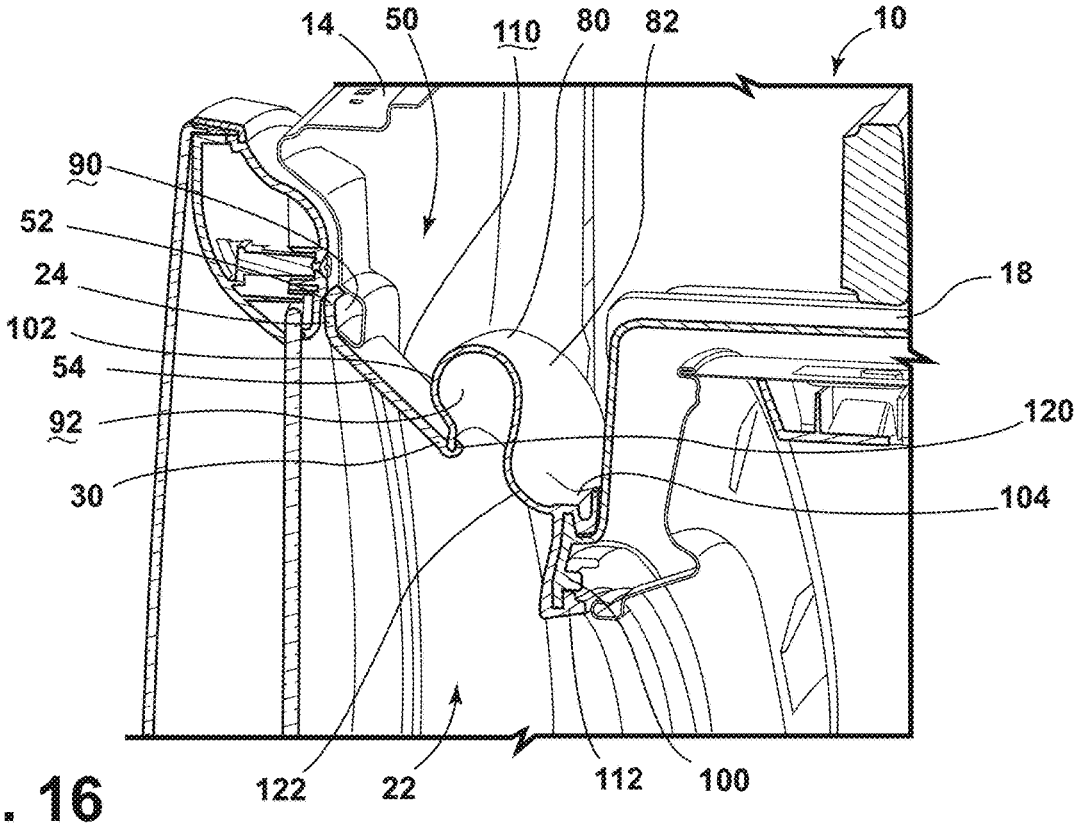
FIG. 16 is a partial cross-sectional, side perspective view of a laundry appliance at a 12 o'clock position of the deflector assembly of FIG. 14 installed in the laundry appliance, according to the present disclosure.

Referring to FIG. 16, at the 12 o'clock position 82, the deflector 22 defines the groove 120 to receive the deflector-side edge 102 of the bellows 28. The closer positioning of the inner edge 30 of the rim 24 and the lip 100 of the tub 18 changes the shape of the bellows 28. The bellows 28 extends vertically from the deflector 22, away from the deflector opening 60, and slightly toward the front panel 14. The bellows 28 defines the primary U-shaped fold 80, which is narrower, with the deflector-side edge 102 and the transition between the primary fold 80 and the secondary fold 122 being closer together. In other words, the portions of the bellows 28 defining the primary fold 80 are disposed closer together.

The bellows 28 extends from the primary fold 80 to transition into and define the secondary fold 122, which is shallower and smaller than the primary fold 80. The secondary fold 122 forms an extension from the primary fold 80 to couple the bellows 28 to the tub 18. The secondary fold 122 has a looser or more gentle curve, while the primary fold 80 has a tighter or sharper curve.

Figure 17:
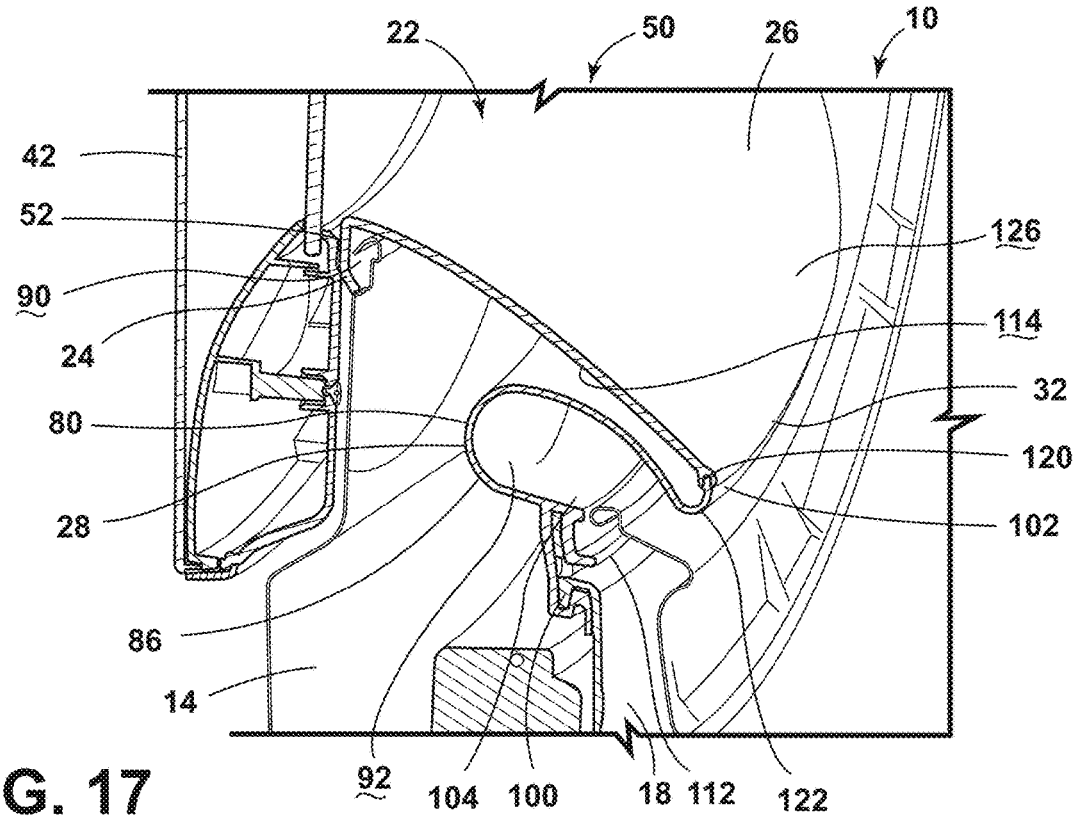
FIG. 17 is a partial cross-sectional, side perspective view of a laundry appliance at a 6 o'clock position of the deflector assembly of FIG. 14 installed in the laundry appliance, according to the present disclosure.

Referring to FIG. 17, at the 6 o'clock position 86 of the bellows 28, the deflector 22 extends through the access opening 20 of the tub 18. The deflector-side edge 102 extends through the access opening 20 to be inserted into the groove 120 in the chute 26. The bellows 28 extends vertically downward from the chute 26 and then under the chute 26 to define the smaller, secondary fold 122, which is formed by the insertion of the bellows 28 into the deflector 22. The bellows 28 defines the primary fold 80 under the deflector 22. The primary fold 80 is elongated and slightly narrow, and the side of the bellows 28 coupled to the deflector 22 is longer than the side coupled to the tub 18. The bellows 28 extends approximately halfway from the interior edge 32 of the chute 26 toward the lower portion 58 of the rim 24.

Figure 18:
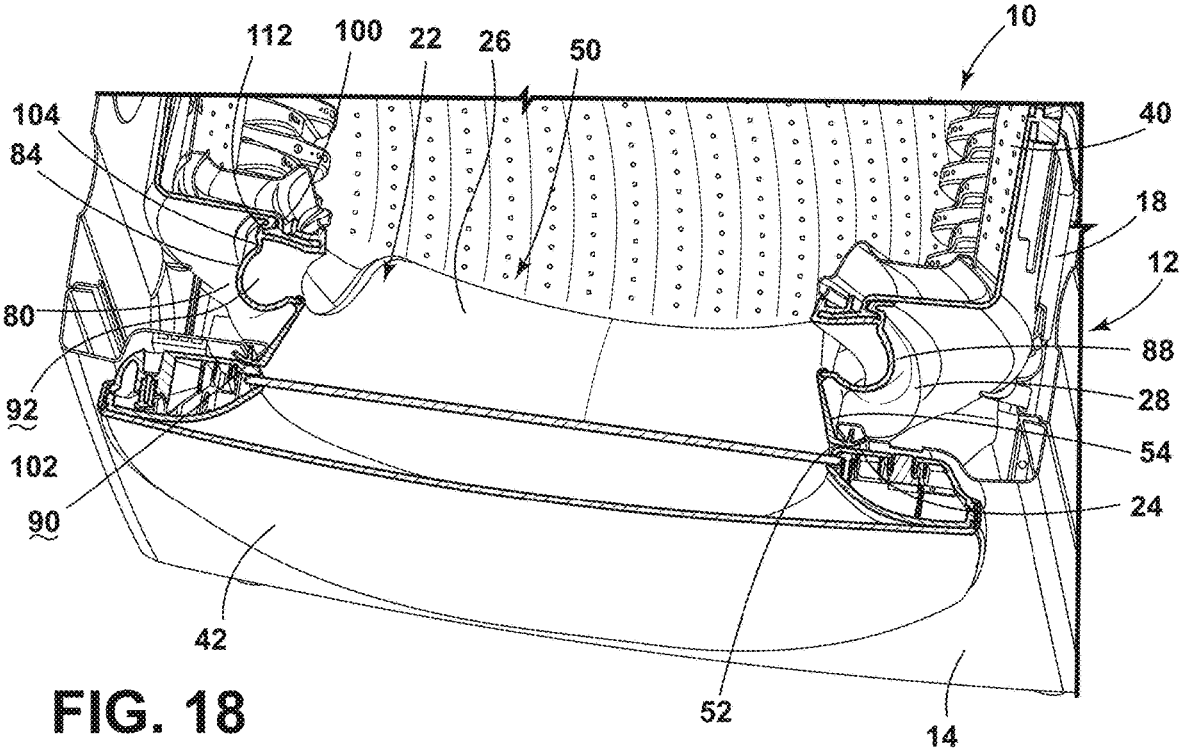
FIG. 18 is a partial cross-sectional, top perspective view of a laundry appliance at a 3 o'clock position and a 9 o'clock position of the deflector assembly of FIG. 14 installed in the laundry appliance, according to the present disclosure.

As illustrated in FIG. 18, the angled insert 54 of the rim 24 also changes the configuration of the bellows 28 and the 3 o'clock position 84 and the 9 o'clock position 88. The insert 54 is oriented more toward a center of the access opening 20, widening a space between the groove 120 and the lip 100 of the tub 18. The increased space widens the U-shape of the bellows 28. Further, due to the angled insert 54, the bellows 28 extend from the groove 120, slightly toward the front of the laundry appliance 10, and then toward a rear of the laundry appliance 10, defining the primary fold 80 that opens at an angle toward the center of the access opening 20.

Figure 19:
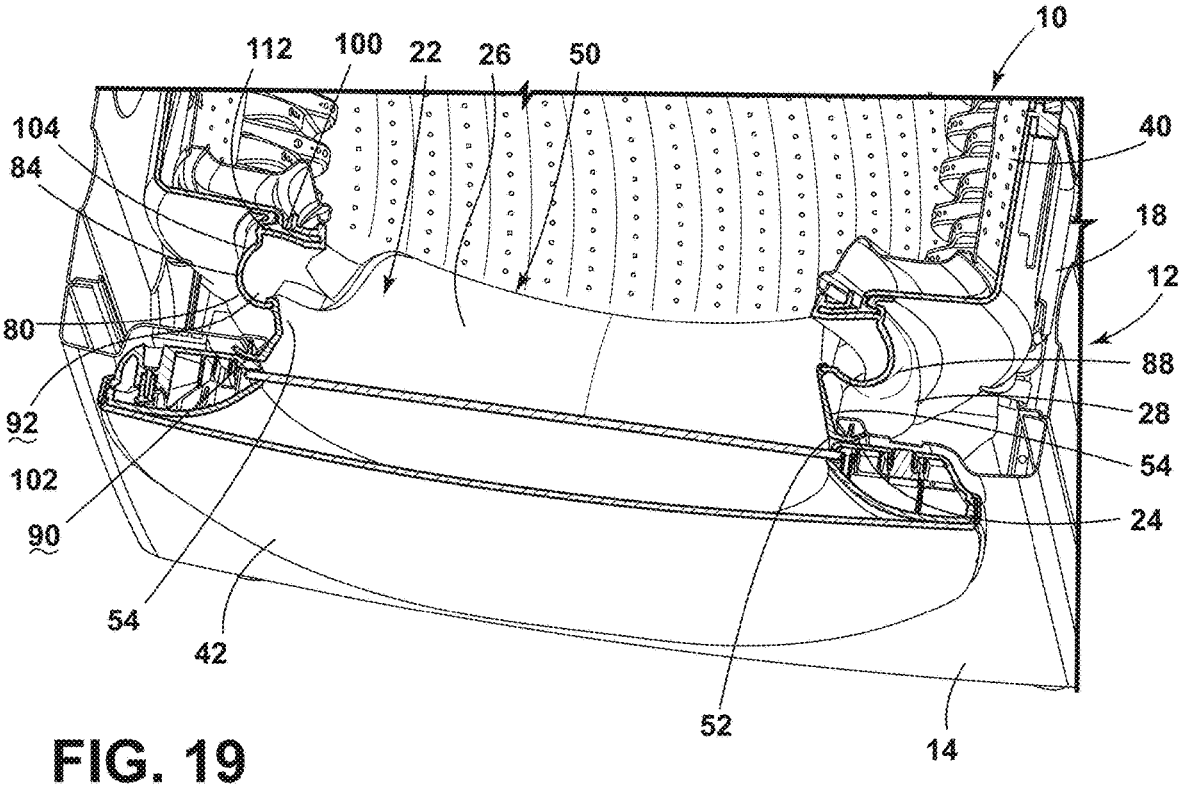
FIG. 19 is a partial cross-sectional, top perspective view of a laundry appliance at a 3 o'clock position and a 9 o'clock position of a deflector assembly installed in the laundry appliance, where the 3 o'clock position of the deflector assembly is different than then the 9 o'clock position, according to the present disclosure.
Figure 20:
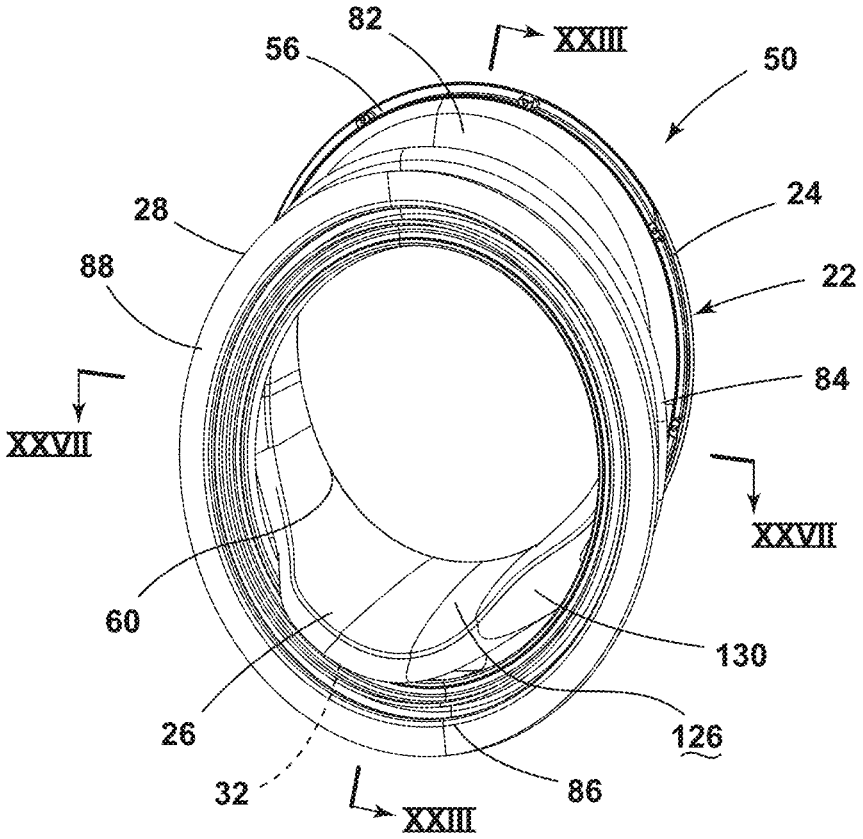
FIG. 20 is a rear perspective view of a deflector assembly, according to the present disclosure.
Figure 21:
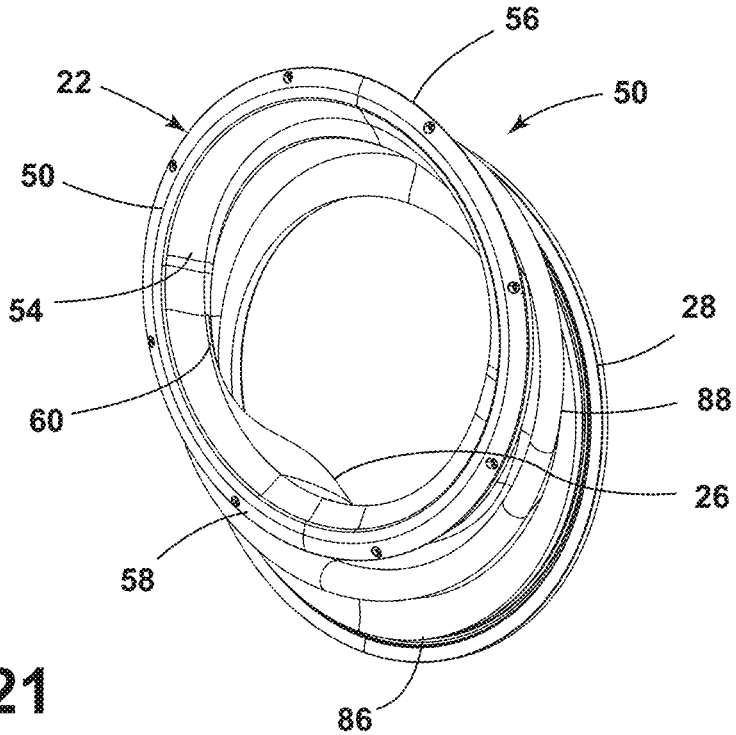
FIG. 21 is a front perspective view of the deflector assembly of FIG. 20, according to the present disclosure.

As illustrated in FIG. 19, a different configuration for the insert 54 of the deflector 22 is illustrated at the 3 o'clock position 84 of the bellows 28 compared to the 9 o'clock position 88 (which is the same as is illustrated in FIG. 1.8). Typically, the sides of the deflector 22 are mirror images of one another but may be different without departing from the teachings herein. The different configurations illustrated in FIG. 19 illustrates how the change in the shape of the deflector 22 changes the shape of the bellows 28. At the 3 o'clock position 84 of the bellows 28, the insert 54 extends partially toward the center of the access opening 20 and then partially away from the center (e.g., toward a left side of the laundry appliance 10). The V-shape and angle of the insert 54 change the location of the deflector-side edge 102 of the bellows 28 relative to the tub 18, changing the shape of the primary fold 80.

At the 3 o'clock position 84, the bellows 28 extends away from the deflector 22 toward the left side of the laundry appliance 10 and slightly toward the front of the laundry appliance and then toward the rear of the laundry appliance 10, slightly toward the center of the access opening 20 to define the primary fold 80. The primary fold 80 opens at an angle toward the center of the access opening 20. The primary fold 80 is shallower and wider at the 3 o'clock position 84, compared to the 9 o'clock position 88, though a distance between the deflector-side edge 102 and the tub-side edge 104 of the bellows 28 remains the same. Generally, this distance is about 25 mm to allow movement of the tub 18.

Figure 24:
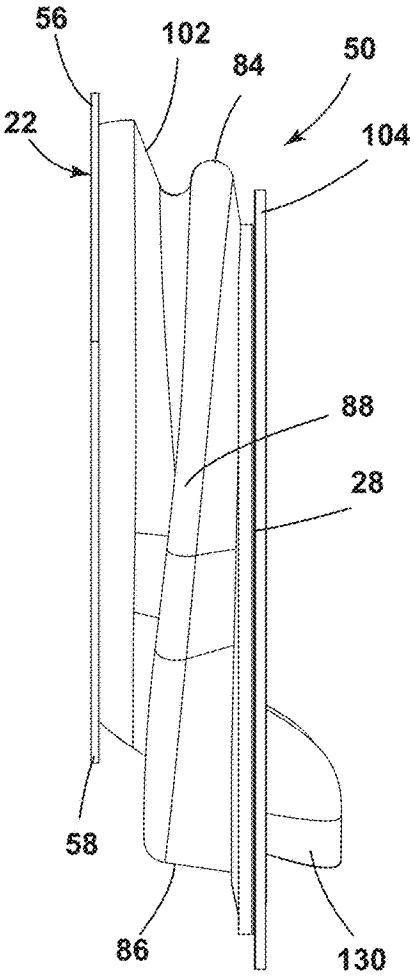
FIG. 24 is a side elevational view of a deflector assembly, according to the present disclosure.

Referring again to FIGS. 20-27, additional or alternative configurations of the deflector assembly 50 are illustrated, where the bellows 28 extends to and is coupled to the inner surface 90 of the rim 24 along both the upper portion 56 and the lower portion 58 of the deflector 22. As illustrated in FIGS. 22, 23, and 25-27, the deflector 22 includes the rim 24 with the insert 54 extending at the oblique angle from the front plate 52 of the rim 24 along the upper portion 56 of the deflector 22 and the lower portion 58, with the chute 26 extending from the insert 54 along the lower portion 58 of the deflector 22. The rim 24 extends inward relative to the deflector opening 60. As illustrated in FIG. 24, the insert 54 extends horizontally and generally perpendicular to the front plate 52 of the rim 24 along the upper portion 56 and slightly downward, away from the deflector opening 60 along the lower portion 58 to integrate into the chute 26. In both configurations of the insert 54, the deflector 22 also includes the annular projection 70 extending along the inner surface 90 of the rim 24.

The bellows 28 couples to the inner surface 90 of the rim 24 360° around the deflector opening 60, extending below and under the chute 26. In the configurations illustrated in FIGS. 20-27, the deflector 22 and the bellows 28 are co-molded into a single component. The bellows 28 may be molded onto the rim 24 and the chute 26 or may be molded onto the lower portion 58 of the deflector 22 and snap-engaged or otherwise coupled to the upper portion 56 after a molding process.

The deflector 22 generally defines a channel 124 between the insert 54 and the annular projection 70. The annular projection 70 may extend through the front opening 16 of the cabinet 12 (FIG. 1), such that the channel 124 is defined within the interior of the cabinet 12. The bellows 28 is coupled to the inner surface 90 of the rim 24 within the channel 124.

Referring still to FIGS. 20-27, in addition to being coupled to the rim 24 along the upper portion 56 and the lower portion 58 of the deflector 22, the bellows 28 is also coupled to the chute 26, reducing or eliminating fluid and debris that can be caught between the chute 26 and the bellows 28. The bellows 28 is coupled to the lower surface 114 of the chute 26, forming or providing the interior edge 32 and therefore providing at least a portion of an upper surface 126 of the chute 26. The bellows 28 defines a receiving space 130, and the chute 26 is seated in the receiving space 130. The receiving space 130 provides additional support for the chute 26 of the deflector 22.

Figure 23:
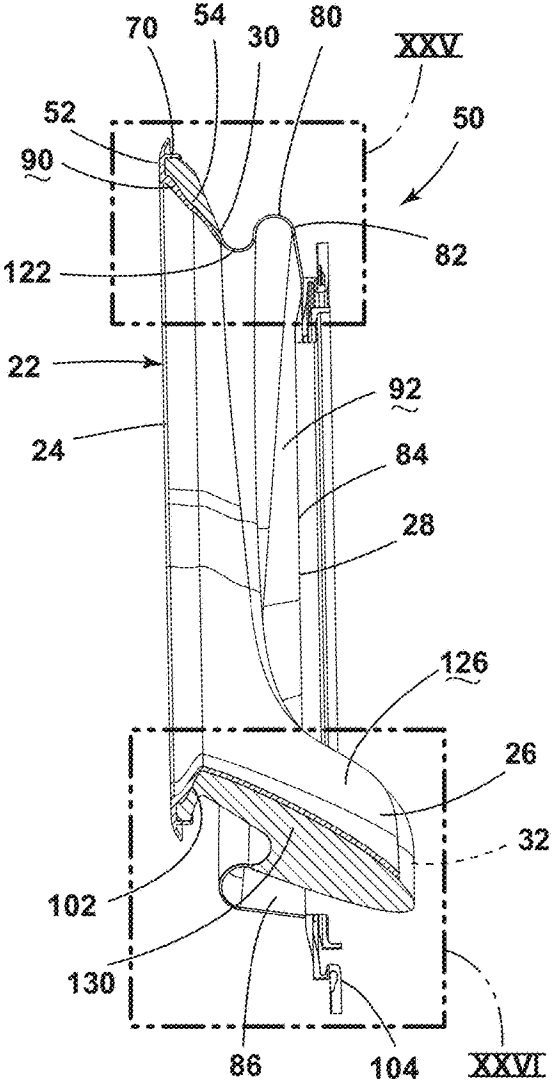
FIG. 23 is a cross-sectional view of the deflector assembly of FIG. 20, taken along the lines XXIII-XXIII, according to the present disclosure.
Figure 22:
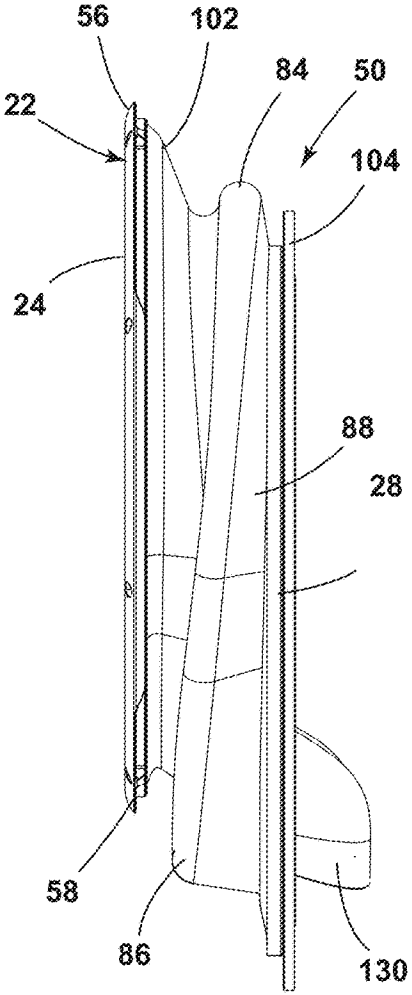
FIG. 22 is a side elevational view of the deflector assembly of FIG. 20, according to the present disclosure.
Figure 25:
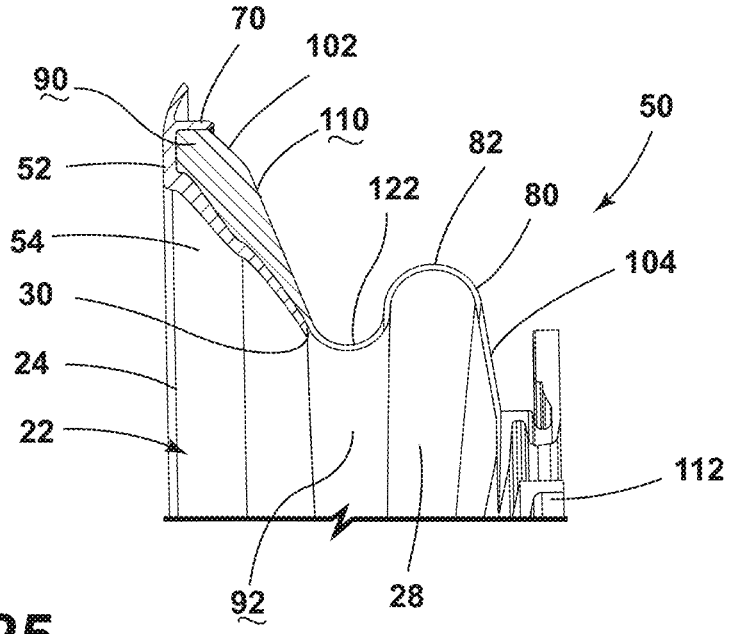
FIG. 25 is a partial enlarged, cross-sectional view of a 12 o'clock position of the deflector assembly of FIG. 23, taken at area XXV, according to the present disclosure.

Referring to FIGS. 23-25, the bellows 28 may have a slightly different configuration based on the configuration of the insert 54 of the deflector 22. For example, as illustrated in FIG. 23, the insert 54 is at the oblique angle, which provides a gradual slope from the deflector-side edge 102 of the bellows 28 of the 12 o'clock position 82. Additionally, at the 6 o'clock position 86, the bellows 28 curves from the annular projection 70, along the angled insert 54, along the lower surface 114 of the chute 26, and over the interior edge 32.

In comparison, as illustrated in FIG. 24, the insert 54 extends perpendicularly or slightly radially outward from the inner surface 90 of the rim 24. In this configuration, the bellows 28 extends along the insert 54 at the 12 o'clock position 82 and then extends at a sharper, downward angle toward the lip 100 of the tub 18. At the 6 o'clock position 86, the bellows 28 extends along the insert 54 and along the lower surface 114 of the chute 26, forming a wider space based on the shallower angle between the insert 54 and the chute 26.

Referring to FIG. 25, at the 12 o'clock position 82 with the obliquely oriented insert 54, the bellows 28 extends from the inner surface 90 of the rim 24 adjacent to the annular projection 70, along the outer surface 110 of the insert 54, and past the inner edge 30 of the insert 54. The bellows 28 also has an increased thickness where the bellows 28 is coupled to the deflector 22. In the example illustrated in FIG. 25, the thickness of the bellows 28 tapers from the inner surface 90 of the rim 24 to the inner edge 30 of the insert 54.

The bellows 28 defines the secondary fold 122 adjacent to the inner edge 30 of the insert 54, which is formed from the bellows 28 following the downward slope of the insert 54 to where the bellows 28 defines the primary U-shaped fold 80. The primary fold 80 is U- or cane-shaped, extending from the secondary fold 122 to the receiving portion 112 configured to receive the lip 100 of the tub 18 (FIG. 2). While the overall shape of the bellows 28 is more S-shaped, the portion between the inner edge 30 of the deflector 22 the tub 18, which is exposed to fluid during a laundry cycle, is more U-shaped with the smaller secondary fold 122. Additionally, the primary fold 80 and the secondary fold 122 may be substantially similar.

Figure 26:
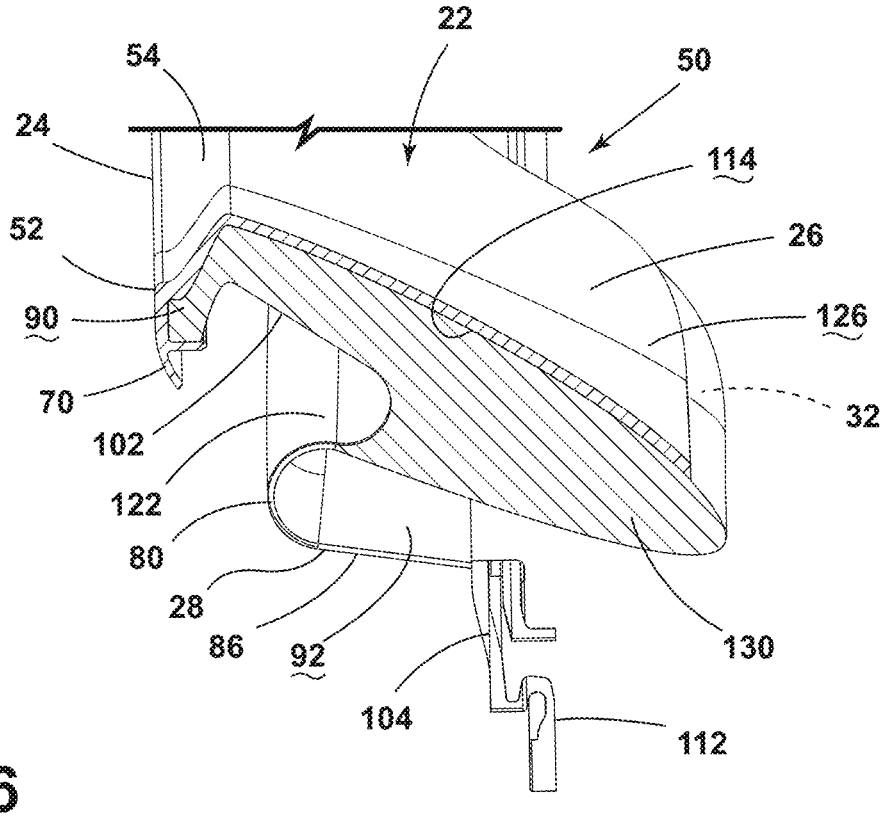
FIG. 26 is a partial enlarged, cross-sectional view of a 6 o'clock position of the deflector assembly of FIG. 23, taken at area XXVI, according to the present disclosure.

Referring to FIG. 26, at the 6 o'clock position 86, the bellows 28 extends from the inner surface 90 of the rim 24 adjacent to the annular projection 70, along the obliquely oriented insert 54, then along the lower surface 114 of the chute 26 and defines the primary fold 80 under the chute 26. The bellows 28 has an increased thickness where the bellows 28 abuts and extends along the deflector 22. As illustrated in FIG. 26, the bellows 28 has a first thickness proximate to the rim 24, a second, greater thickness proximate a higher portion of the chute 26, and a third, greatest thickness along a lower portion of the chute 26 with the interior edge 32. The thickest portions of the bellows 28 defines the receiving space 130 for receiving and supporting the chute 26.

The bellows 28 defines an overall S-shape, with the secondary fold 122 opening toward the front panel 14 defined under the chute 26 adjacent to the rim 24 and the primary fold 80 under the chute 26 adjacent to the interior edge 32 and opening toward the tub 18. While the overall shape of the bellows 28 is an S-shape, the portion of the bellows 28 exposed to fluid during a laundry cycle is the U-shaped opening of the primary fold 80 directed toward the tub 18 (FIG. 1). The U-shape of the primary fold 80 is entirely under the chute 26 and is elongated and narrow.

Figure 27:
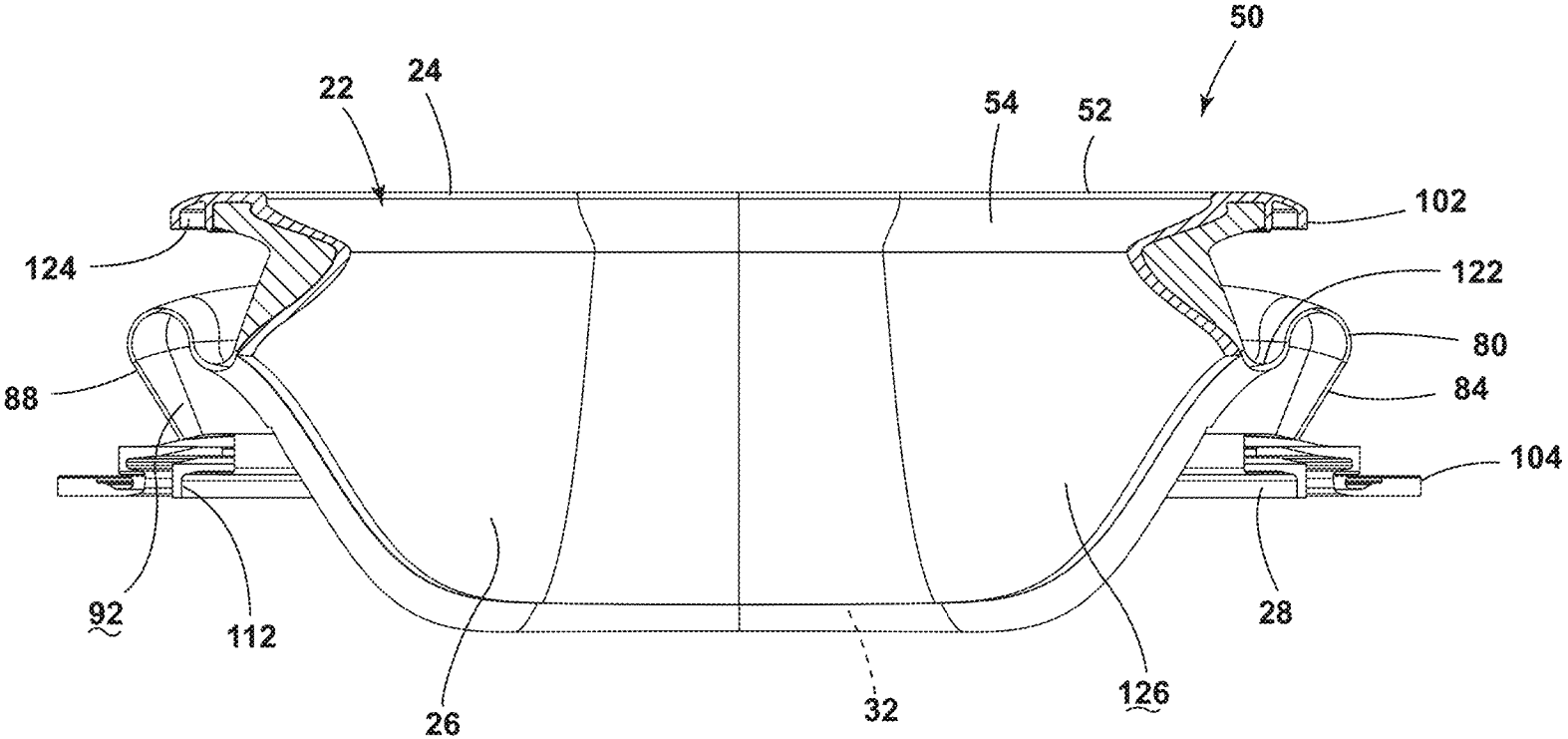
FIG. 27 is a cross-sectional, top elevational view of the deflector assembly of FIG. 20, taken along lines XXVII-XXVII, showing a 3 o'clock position and a 9 o'clock position of the deflector assembly, according to the present disclosure.
Figure 28:
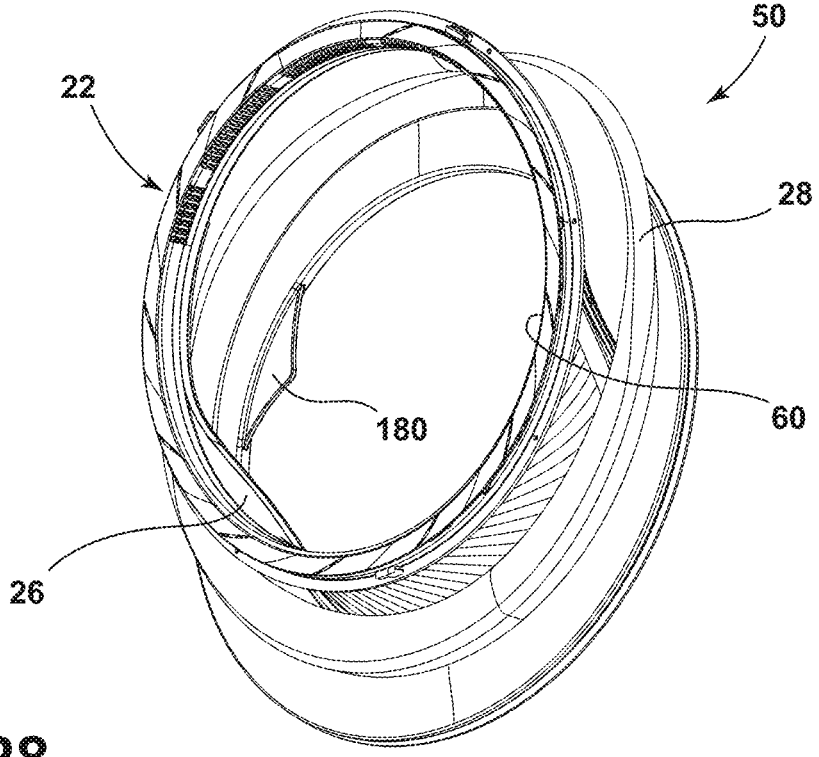
FIG. 28 is a front perspective view of a deflector assembly, according to the present disclosure.
Figure 29:
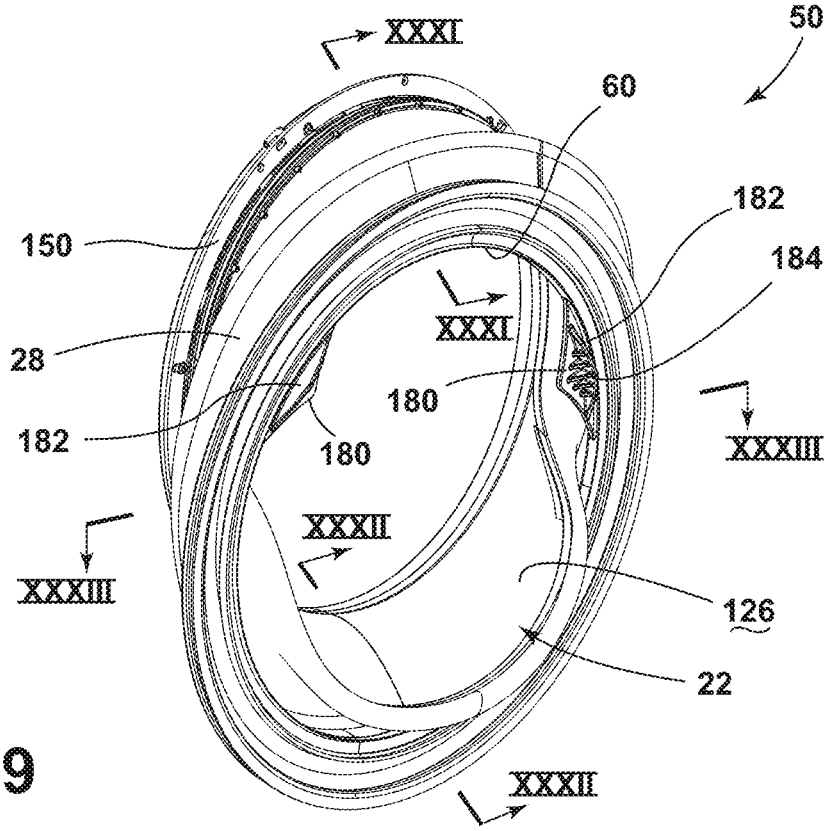
FIG. 29 is a rear perspective view of the deflector assembly of FIG. 28, according to the present disclosure.
Figure 30:
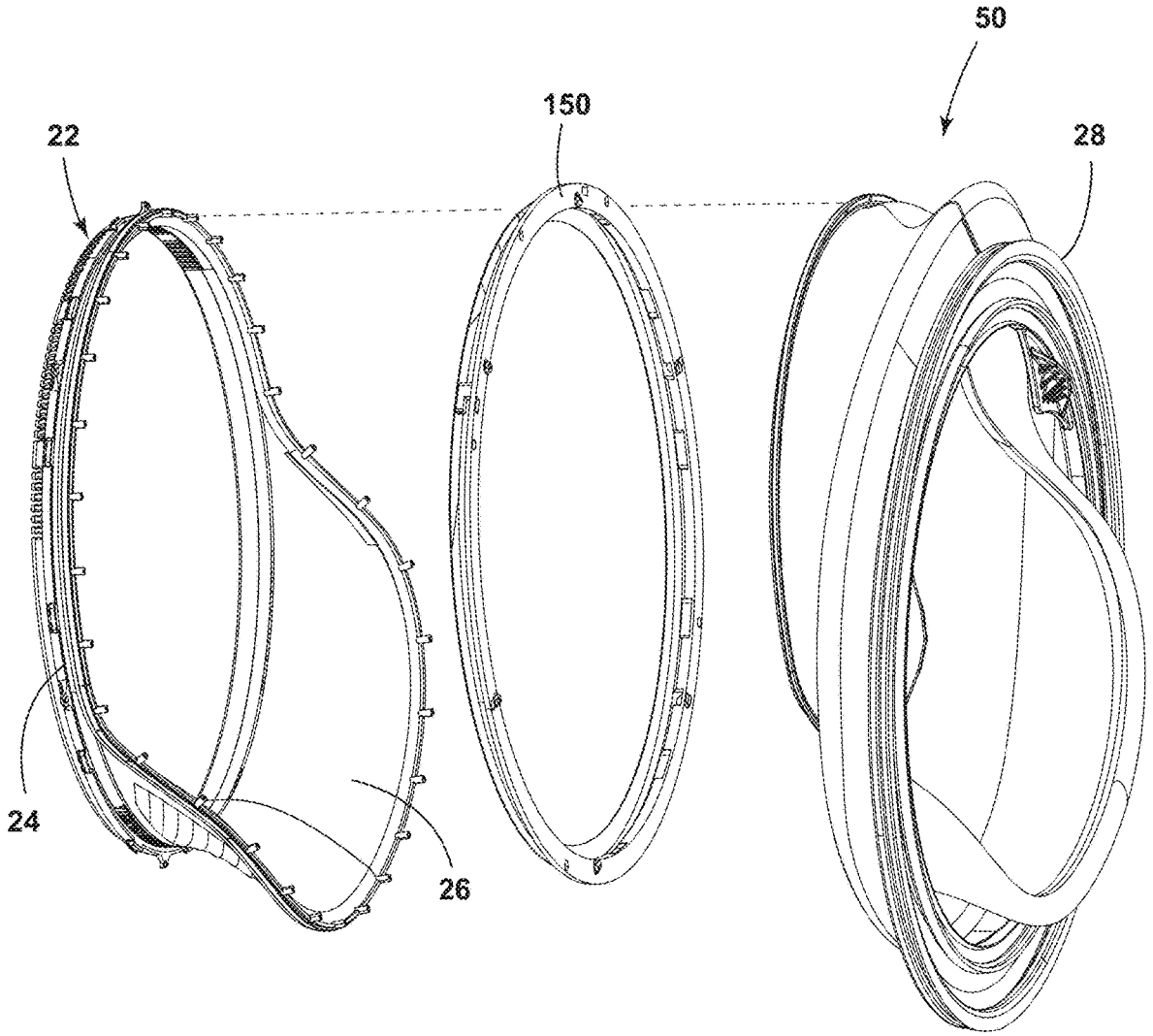
FIG. 30 is an exploded side perspective view of the deflector assembly of FIG. 28, according to the present disclosure.

Referring to FIG. 27, at the sides of the deflector 22, the insert 54 extends at the oblique angle toward the center of the deflector 22 and then extends at an oblique angle away from the center, forming the "V" shape. The bellows 28 extends from the inner surface 90 of the rim 24, partially along the insert 54, and then generally perpendicular to the front plate 52 of the rim 24. The bellows 28 has increased thickness at the 3 o'clock position 84 and the 9 o'clock position 88 to substantially fill the triangular shape defined by the two oblique portions of the insert 54. The bellows 28 then extends beyond the innermost edge 72 of the deflector 22, toward the front plate 52 of the deflector 22, and to the receiving portion 112 to engage the tub 18 (FIG. 1), defining the primary fold 80. The primary fold 80 at the 3 o'clock position 84 and the 9 o'clock position 88 are angled toward one another and are narrow. Additionally, the side of the primary fold 80 adjacent to the deflector 22 is shorter than the side configured to engage the tub 18.

The overall configuration of the bellows 28 at the 3 o'clock position 84 and the 9 o'clock position 88, including the portion of increased thickness, is generally an S-shape. The portion of the bellows 28 exposed to fluid during a laundry cycle (e.g., the portion between the innermost edge 72 of the deflector 22 and the receiving portion 112 is generally U-shaped, promoting the fluid flow along the inner surface 92.

Referring still to FIGS. 22-27, this configuration of the deflector assembly 50 utilizes additional material for the bellows 28 while still maintaining the general "U" shapes for the primary fold 80 between the innermost edge 72 of the deflector 22 and the tub 18. The additional material fills in spaces between the rim 24 and the chute 26 and between the front plate 52 of the rim 24 and the insert 54, as well as defines the receiving space 130 for supporting the chute 26. The bellows 28 may be co-molded or over-molded onto the deflector 22 providing a single, integrated component. Additionally or alternatively, a portion of the bellows 28, such as the portion of the bellows 28 that defines the receiving space 130 may be molded onto the chute 26, while the bellows 28 may be snap-engaged, pressed, or otherwise coupled to the upper portion 56 of the deflector 22 after being molded to the chute 26.

With reference to FIGS. 28-35, an additional or alternative configuration of the deflector assembly 50 is illustrated, which includes the deflector 22, the bellows 28, and an additional interior support feature 150. The bellows 28 is coupled to the innermost edge 72 of the deflector 22, extending 360° about the deflector opening 60. The bellows 28 extends below the chute 26 and is spaced from the inner surface 90 of the rim 24. The support feature 150 is coupled to the inner surface 90 of the rim 24, also extending 360° about the deflector opening 60.

The deflector 22 includes the rim 24 with the front plate 52 and the insert 54 extending generally perpendicular to the front plate 52. The rim 24 defines apertures 152, which are illustrated in groupings along the upper portion 56 of the front plate 52 and the insert 54. The apertures 152 may assist in providing airflow along the inner surface 90 of the deflector 22, such as between the inner surface 90 and the support feature 150. The insert 54 is configured to extend through the access opening 20 (FIG. 1). The insert 54 has an outer portion 154 adjacent to the front plate 52 that has an increased thickness relative to other configurations, providing additional strength and rigidity to the deflector 22 about the deflector opening 60.

Referring still to FIGS. 28-35, the deflector 22 includes an engagement feature 156 forming the entirety of the innermost edge 72. Accordingly, the engagement feature 156 extends along the insert 54 at the upper portion 56 and along the chute 26 at the lower portion 58 of the deflector 22. The engagement feature 156 may have different configurations at different locations of the deflector 22 as described further herein. Generally, the engagement feature 156 extends outward from the deflector opening 60, parallel to the front plate 52, and provides an engagement location between the bellows 28 and the deflector 22. The engagement feature 156 may be molded with the deflector 22.

The engagement feature 156 defines projections 164 spaced apart along the innermost edge 72 of the deflector 22. The projections 164 extend outward from the deflector 22, generally toward a rear of the laundry appliance 10. The projections 164 extend towards the tub 18 and may be positioned at different angles based on the configuration of the innermost edge 72. For example, some of the projections 164 may extend toward a top of the laundry appliance 10 while some projections 164 extend toward a bottom of the laundry appliance 10. The projections 164 may be configured to engage the bellows 28, retaining a shape of the bellows 28 adjacent to the deflector 22. For example, as the bellows 28 move due to movement of the tub 18, a space may be maintained between the bellows 28 and the innermost edge 72 by the projections 164. This configuration may also reduce wear on the engagement between the deflector 22 and the bellows 28. The projections 164 may also assist with deflecting items toward the drum 40 and may increase the rigidity or strength of the deflector 22 at the innermost edge 72.

Additionally, the engagement feature 156 defines elongate ribs 166 that also extend toward the interior of the tub 18. The elongate ribs 166 extend a lesser distance from the innermost edge 72 of the deflector 22 relative to the projections 164. The elongate ribs 166 are disposed between the projections 164, generally extending along the interior edge 32 of the chute 26 from one projection 164 to the adjacent projection 164.

The bellows 28 is coupled to and extends along an entirety of the innermost edge 72 of the deflector 22, extending 360° about the deflector opening 60. The bellows 28 may be coupled to the projections 164 and the elongate ribs 166. In the illustrated example, the bellows 28 is coupled to the deflector 22 around the projections 164 and over the elongate ribs 166, which may assist in maintaining the engagement between the innermost edge 72 of the deflector 22 and the bellows 28. In such examples, the bellows 28 defines grooves 168 in the deflector-side edge 102 to receive the elongate ribs 166 and apertures 170 through which the projections 164 extend. Moreover, the bellows 28 defines at least the primary fold 80 and, often, both the primary fold 80 and the secondary fold 122 or three folds 80, 122, 174 at various positions about the deflector 22 as the bellows 28 extends between the deflector 22 and the tub 18 (FIG. 1).

In various aspects, the bellows 28 defines wings 180 extending from the receiving portion 112 at the tub-side edge 104 of the bellows 28. As illustrated, the wings 180 form an extension of the receiving portion 112, extending inward and toward one another. The wings 180 are mirror images of one another and are generally positioned between the 12 o'clock position 82 and the 3 o'clock position 84 and between the 12 o'clock position 82 and the 9 o'clock position 88, respectively. The wings 180 define a generally triangular shape, with a support ridge 182 extending perpendicularly from each wing 180. The support ridge 182 has a triangular shape and extends further into the tub 18 (FIG. 2). Multiple support ribs 184 extend from an inner surface of the wings 180 to the support ridges 182, to increase the strength and rigidity of the support ridges 182 and the wings 180. The wings 180 provide deformable components at the upper portion 56 of the deflector assembly 50 configured to assist in deflecting items toward the drum 40.

Figure 31:
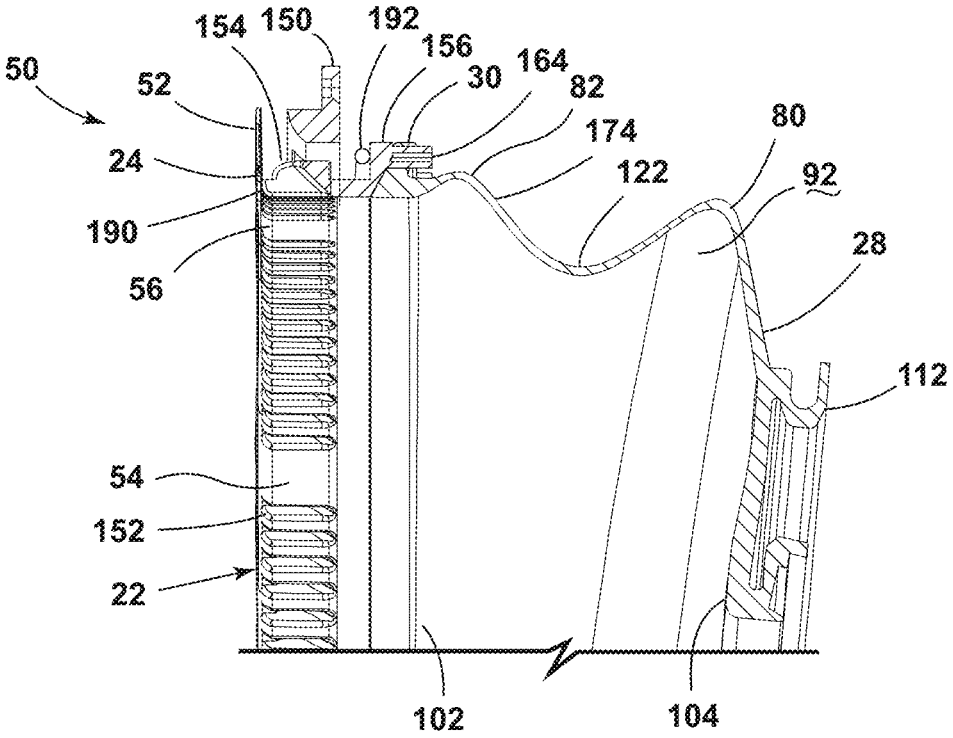
FIG. 31 is a partial enlarged cross-sectional view of a 12 o'clock position of the deflector assembly of FIG. 29, taken along lines XXXI-XXXI, according to the present disclosure.

As illustrated in FIG. 31, at the 12 o'clock position 82, each of the deflector 22 and the bellows 28 defines a certain configuration. The outer portion 154 of the insert 54 has the increased thickness and defines the apertures 152 therein. The engagement feature 156 forming the inner edge 30 of the insert 54 is spaced from the outer portion 154 of the insert 54 by a recessed region 190 defined in the outer surface 110 of the rim 24. In this way, the thicker outer portion 154 of the insert 54 and the engagement feature 156 have an increased height relative to a portion therebetween to form a recess.

The recess opens outward, away from the deflector opening 60. In various aspects, the deflector assembly 50 includes a support ring 192 coupled to the engagement feature 156 along an entirety of the innermost edge 72 of the deflector 22. The support ring 192 may provide additional support for the innermost edge 72 of the deflector 22 and the engagement with the bellows 28. At the 12 o'clock position 82, the support ring 192 is positioned within the recess, abutting the engagement feature 156.

Referring still to FIG. 31, at the 12 o'clock position 82, the deflector-side edge 102 of the bellows 28 is coupled to the engagement feature 156 of the deflector 22. The deflector-side edge 102 of the bellows 28 has an increased thickness to couple to the engagement feature 156. The deflector-side edge 102 extends from the inner surface 90 of the engagement feature 156 to the projections 164, filing a space between the inner surface 90 and the projections 164.

The bellows 28 forms a loose "M" shape, having three folds 80, 122, 174. The primary fold 80 is the largest fold and forms a general "V" shape with a sharp curve. The primary fold 80 is defined adjacent to the receiving portion 112 that is configured to engage the lip 100 of the tub 18 (FIG. 2). The "V" of the primary fold 80 is open toward the deflector opening 60 to provide the inner surface 92 for the fluid flow along the bellows 28. The secondary fold 122 is adjacent to the primary fold 80 and closer to the deflector 22. The secondary fold 122 is a wide "U" or "V" shape, having a shallower curve than the primary fold 80. The secondary fold 122 opens in an opposing direction relative to the primary fold 80.

Further, at the 12 o'clock position 82, the bellows 28 defines the tertiary fold 174, which is the smallest fold. The tertiary fold 174 is formed by the bellows 28 extending from the engagement feature 156. The bellows 28 extends below the projections 164 and slightly toward the projections 164 to form the shallow tertiary fold 174. The tertiary fold 174 opens in the same direction as the primary fold 80.

Figure 32:
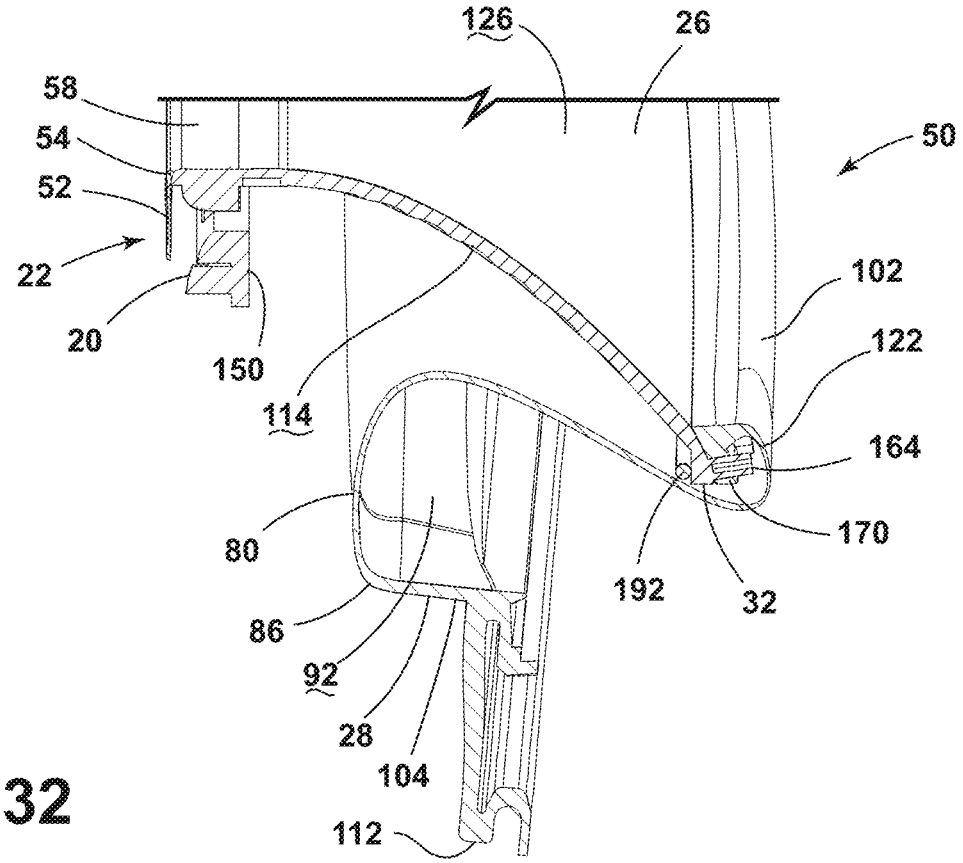
FIG. 32 is a partial enlarged cross-sectional view of a 6 o'clock position of the deflector assembly of FIG. 29, taken along lines XXXII-XXXII, according to the present disclosure.

With reference to FIG. 32, at the 6 o'clock position 86, the engagement feature 156 forms a downward extension having an increased thickness, defining an obtuse angle with the lower surface 114 of the chute 26. The engagement feature 156 defines the projections 164 and the elongate ribs 166, extending toward the interior of the tub 18. The support ring 192 is coupled to the lower surface 114 of the chute 26 along the engagement feature 156.

The bellows 28 is coupled to the upper surface 126 and the interior edge 32 of the chute 26, extending around the projections 164 and over the elongate ribs 166. The deflector-side edge 102 of the bellows 28 has an increased thickness. The thicker deflector-side edge 102 extends from the interior edge 32 of the chute 26 and along the upper surface 126 of the chute 26 toward the rim 24. Further, the thicker deflector-side edge 102 extends outward from the upper surface 126 of the chute 26 toward the center of the drum 40 (FIG. 1), tapering as the bellows 28 extend over the projections 164. This thicker extension away from the chute 26 tapers to a generally consistent thickness along the remainder of the bellows 28 to the receiving portion 112.

At the 6 o'clock position 86, the bellows 28 defines the primary fold 80 and the secondary fold 122. The primary fold 80 is defined adjacent to the receiving portion 112 and is positioned below the deflector 22. The primary fold 80 defines a wide curve with the side that extends closer to the lower surface 114 of the chute 26 being longer to form a reverse "J" shape. The primary fold 80 opens toward the tub 18 to provide the inner surface 92 for fluid flow along the bellows 28.

The secondary fold 122 is formed from the engagement of the deflector-side edge 102 of the bellows 28 and the upper surface 126 of the chute 26. The bellows 28 extends away from the upper surface 126 of the chute 26, around the projections 164, and around the interior edge of the chute 26, forming a smaller, tighter curve for the secondary fold 122. As illustrated, the secondary fold 122 follows the curve around the interior edge of the chute 26. The secondary fold 122 generally defines a sharper curve than the primary fold 80 and is configured to extend adjacent to or abut the support ring 192. The support ring 192 may assist in maintaining the shape of the bellows 28 below the chute 26.

Referring still to FIG. 32, the projections 164 may act as a buffer between the chute 26 and the bellows 28 and retain the shape of the secondary fold 122 of the bellows 28. Moreover, this configuration of the bellows 28 extending around the interior edge 32 of the chute 26 forms a flexible buffer along the chute 26, which may assist with deflecting items back toward the drum. Moreover, this rounded configuration may protect the engagement between the chute 26 and the deflector-side edge 102 of the bellows 28.

Figure 33:
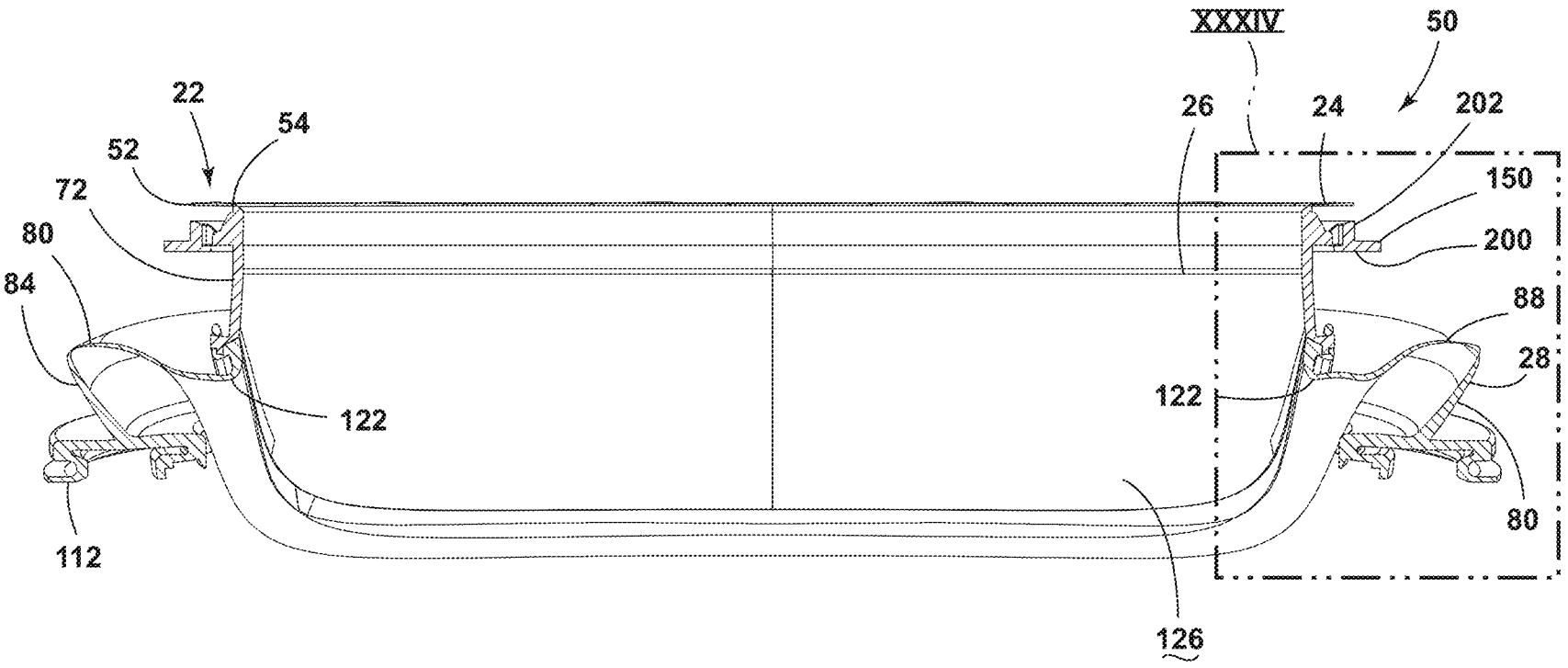
FIG. 33 is a cross-sectional, top elevational view of the deflector assembly of FIG. 29, taken along lines XXXIII-XXXIII, showing a 3 o'clock position and a 9 o'clock position of the deflector assembly, according to the present disclosure.
Figure 34:
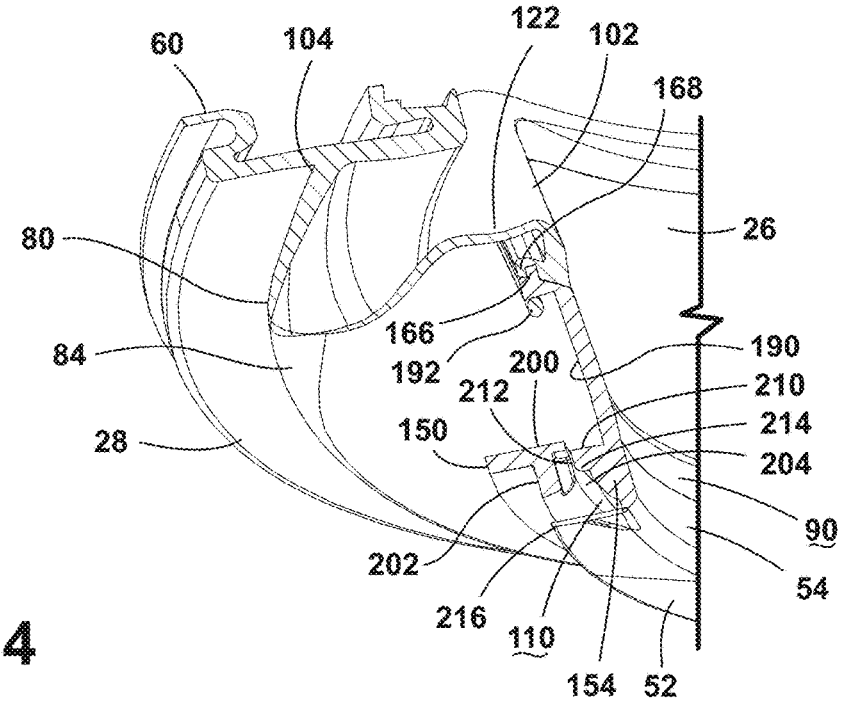
FIG. 34 is a partial enlarged cross-sectional, top perspective view of the 3 o'clock position of FIG. 33, taken at area XXXIV, according to the present disclosure.

Referring to FIGS. 33 and 34, the 3 o'clock and the 9 o'clock positions 84, 88 are illustrated, including an isolated view of the 3 o'clock position 84. The 3 o'clock position 84 and the 9 o'clock position 88 are generally mirror images of one another. The engagement feature 156 extends outwardly toward opposing sides of the laundry appliance 10 (FIG. 1). The outer portion 154 of the rim 24 remains adjacent to the front plate 52 as in the 12 o'clock position 82 (FIG. 31) and the 6 o'clock position 86 (FIG. 32). As the outer portion 154 maintains a same depth around the deflector opening 60 and the engagement feature 156 forms the interior edge 32 of the chute 26, the recessed region 190 between the outer portion 154 and the engagement feature 156 increases in size. The support ring 192 is coupled to the engagement feature 156.

The deflector 22 defines the projections 164 and the elongate ribs 166, with the bellows 28 extending over the elongate ribs 166 and around the projections 164 at the 3 o'clock and the 9 o'clock positions 84, 88. The deflector-side edge 102 of the bellows 28 defines the increased thickness and extends from the interior edge 32, over the elongate ribs 166, and along the upper surface 126 of the deflector 22 before extending away from the upper surface 126.

At the 3 o'clock position 84 and the 9 o'clock position 88, the bellows 28 defines at least the primary fold 80 and the secondary fold 122. The primary fold 80 is generally a sharper "V" shape that opens an angle toward the center of the access opening 20. The secondary fold 122 is smaller and shallower. The bellows 28 extends outward, toward the sides of the laundry appliance 10 (FIG. 1) to form an extension of the upper surface 126 of the chute 26. The bellows 28 then curves toward the front panel 14 of the laundry appliance 10, around the projections 164, before transitioning into the primary fold 80. It is contemplated that, based on the movement of the tub 18, the bellows 28 may define the tertiary fold 174 adjacent to the deflector 22 at the 3 o'clock and the 9 o'clock positions 84, 88 without departing from the teachings herein.

Figure 35:
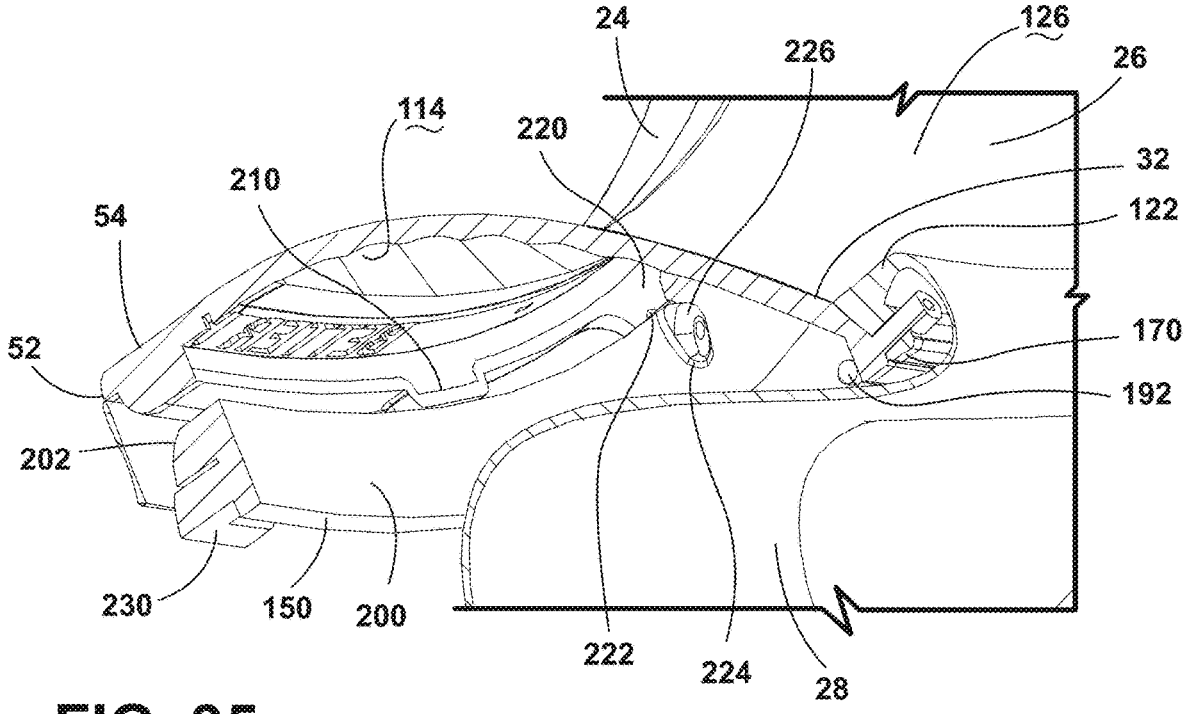
FIG. 35 is a partial cross-sectional, bottom perspective view of the 6 o'clock position of the deflector assembly of FIG. 29, taken along lines XXXII-XXXII, according to the present disclosure.

Referring again to FIG. 31, still to FIG. 34, and to FIG. 35, the support feature 150 is coupled to the inner surface 90 of the rim 24 and extends 360° about the deflector opening 60. The support feature 150 is disposed outside of the ring formed by the bellows 28 and extends under the chute 26. The support feature 150 includes an inner plate 200 that is spaced from and extends generally parallel to the front plate 52 of the deflector 22. Additionally, the support feature 150 includes an annular extension 202 that extends from the inner plate 200 and toward the front plate 52 of the deflector 22, forming a generally L-shaped cross-section.

In various aspects, as illustrated in FIG. 34, at multiple locations, there are engagements between the front plate 52, the insert 54, and/or the support feature 150. The rim 24 defines snap flanges 204 extending perpendicular from the front plate 52 and toward the support feature 150. The snap flanges 204 extend generally parallel to the insert 54. The insert 54 defines protrusions 210 with snap features 212, which extend toward the snap flanges 204 and are configured to snap engage receiving apertures 214 defined by the snap flanges 204. The protrusions 210 are also configured to abut the snap flanges 204 adjacent to the receiving apertures 214. Further, the support feature 150 defines recesses 216 in the inner plate 200 to receive ends of the snap flanges 204. This configuration provides a three-way engagement between the insert 54, the front plate 52, and the support feature 150 for maintaining the engagements therebetween.

As illustrated in FIG. 35, the insert 54 defines coupling flanges 220 extending therefrom, generally toward the annular extension 202 of the support feature 150. The coupling flanges 220 each define apertures 222 that are configured to align with apertures 224 defined in the support feature 150. Coupling members 226 are configured to extend through the apertures 222, 224 to couple the support feature 150 to the insert 54.

Further, as illustrated in FIG. 35, the deflector 22 may define abutment features 230 that assist in maintaining the space between the front plate 52 of the deflector 22 and the inner plate 200 of the support feature 150. The abutment features 230 are L-shaped, extending to and along the inner surface 90 of the front plate 52. The abutment features 230 are positioned outside the annular extension 202, adjacent to an outer edge of the front plate 52. The support feature 150 may provide additional strength to the rim 24 of the deflector 22 for supporting movement of the bellows 28, as well as supporting the engagement between the deflector assembly 50 and the laundry appliance 10.

With reference still to FIGS. 31-35, the deflector assembly 50 in this configuration utilizes the engagement feature 156 having the projections 164 and elongated ribs 166 for coupling the deflector-side edge 102 of the bellows 28 to the deflector 22. The deflector 22 remains between the bellows 28 and the front panel 14, reducing the material utilized for the bellows 28. The bellows 28 and the deflector 22 form an integrated component for installation into the laundry appliance 10. This deflector assembly 50 also utilized the support feature 150 for providing additional strength to the deflector assembly 50.

Referring again to FIGS. 3-35, the deflector assembly 50 provides an integrated component to be installed as one piece with the laundry appliance 10. Generally, the deflector assembly 50 utilizes less materials for the bellows 28 compared to conventional bellows assemblies. Additionally, the deflector 22 is positioned between the bellows 28 and the front panel 14. In this way, the deflector assembly 50, including both the deflector 22 and the bellows 28, is installed together in the laundry appliance 10 through engagements between the front panel 14 and the deflector 22. There is generally no direct, mechanical attachment between the bellows 28 and the front panel 14.

In each configuration of the deflector assembly 50, the bellows 28 may be molded or coupled to the innermost edge 72 of the deflector 22. The bellows 28 may define the notch 108 to receiving the deflector 22 (as illustrated in FIGS. 3-8), inserted into the groove 120 of the deflector 22 (as illustrated in FIGS. 9-19), coupled to the inner surface 90 of the rim 24 and over the interior edge 32 of the chute 26 (as illustrated in FIGS. 20-27), or coupled to an engagement feature 156 of the deflector 22 (as illustrated in FIGS. 30-35).

Additionally or alternatively, additional components may be utilized to couple the bellows 28 to the deflector 22 or secure the engagement between the bellows 28 and the deflector 22. For example, the bellows 23 may extend along and abut the deflector 22. In such examples, a fastener, such as a screw or snap feature may retain the bellows 23 to the deflector 22. Additionally or alternatively, a U-shaped feature may be press-fit, snap-fit, or otherwise coupled around the innermost edge 72 of the deflector 22, similar to a spline. The U-shaped features may be disposed at intervals, extend along a substantial portion of the innermost edge 72, or extend along the entirety of the innermost edge 72 of the deflector 22.

Figure 36:
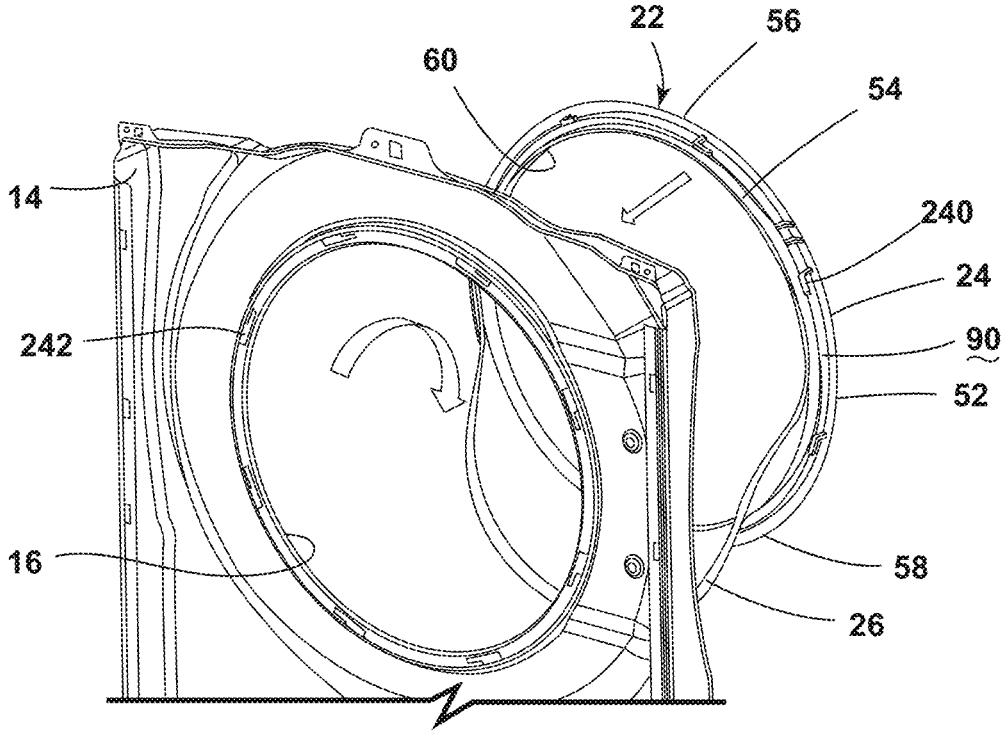
FIG. 36 is a partial rear perspective exploded view of a deflector and a front panel of a cabinet of a laundry appliance, according to the present disclosure.
Figure 37:
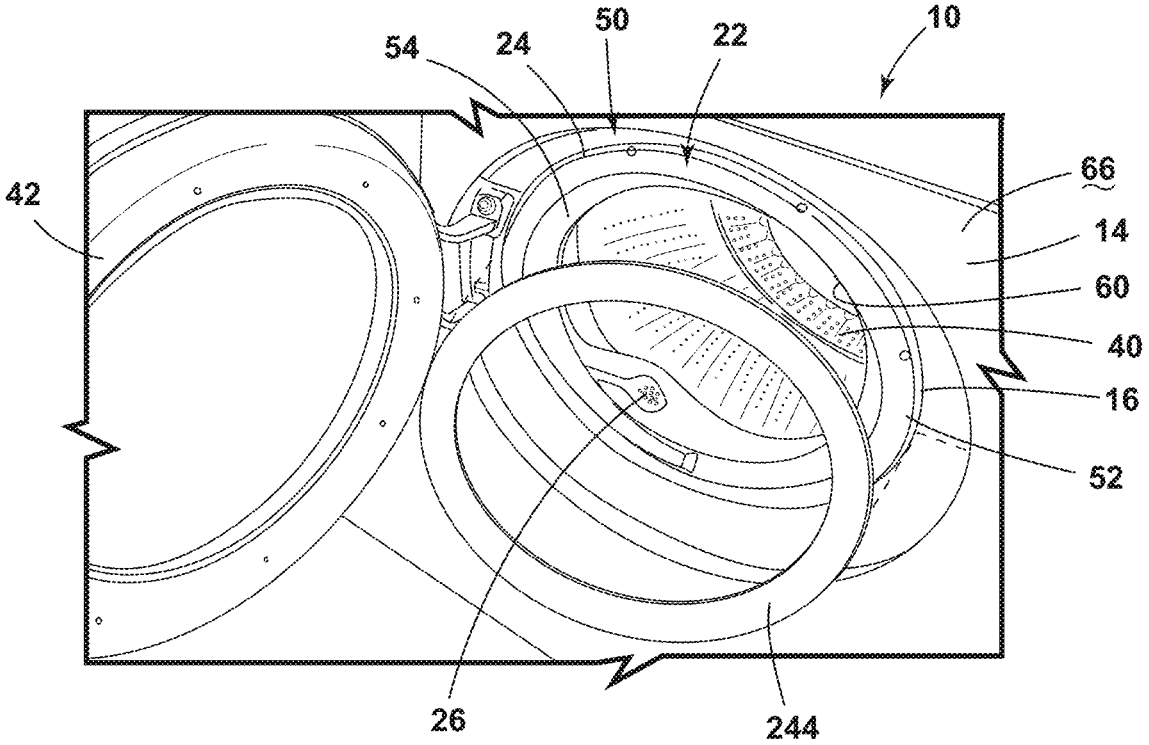
FIG. 37 is a partial front perspective exploded view of a laundry appliance with a deflector assembly and a trim member, according to the present disclosure.
Figure 38:
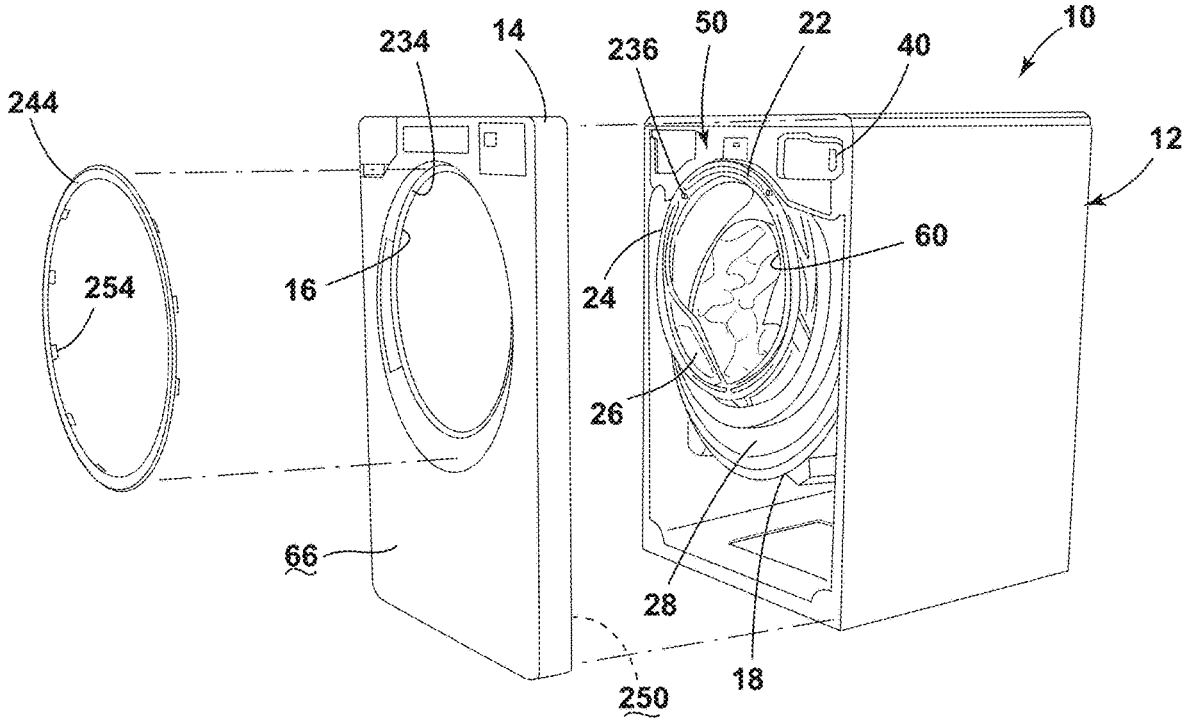
FIG. 38 is a partially exploded side perspective view of a laundry appliance with a deflector assembly disposed within a cabinet and a trim member, according to the present disclosure.

Referring to FIGS. 36 and 37, as well as further reference to FIGS. 1-35, the deflector assembly 50 may be coupled to the front panel 14 of the laundry appliance 10 in a variety of ways. For example, as illustrated in FIG. 36, the deflector 22, illustrated with the bellows 28 removed for clarity, may define projections or hook features 240 along the inner surface 90 of the front plate 52 of the rim 24. In such examples, the hook features 240 are disposed outside of the annular projection 70 (i.e., between the annular projection 70 and an outer edge of the front plate 52). The front panel 14 may define slots 242 around the front opening 16. The deflector assembly 50, with the bellows 28 attached, may be positioned to insert the hook features 240 through the slots 242 and then rotated to secure the deflector assembly 50 to the front panel 14. This configuration may be advantageous for concealing the attachment between the deflector assembly 50 and the cabinet 12.

Additionally or alternatively, as illustrated in FIG. 37, the front plate 52 of the rim 24 may abut the front surface 66 of the front panel 14. In such examples, the front plate 52 of the rim 24 may be fastened or otherwise coupled to the front panel 14 with coupling members, such as screws or pins. In various aspects, a trim member 244 may be coupled to the rim 24 or the front panel 14 to conceal the attachment points (e.g., the coupling members) between the rim 24 and the front panel 14. The trim member 244 may be fastened, snap-fit, or otherwise coupled to the front panel 14 and/or the rim 24 of the deflector 22.

Referring to FIG. 33, the deflector assembly 50 is illustrated inside the cabinet 12, behind the front panel 14. The front panel 14 defines locating apertures 234 adjacent to the access opening 20. The deflector 22 defines locating projections 236, which are configured to be inserted into or through the locating apertures 234 to reduce movement of the deflector assembly 50 relative to the front panel 14, as well as properly position the deflector assembly 50 relative to the front panel 14. In such examples, the deflector assembly 50 is installed on the tub 18 and the front panel 14 is then installed over the deflector assembly 50. Additional coupling members may be utilized to couple the deflector 22 to the front panel 14.

Further, in the illustrated configuration, the deflector assembly 50 is abutting an interior surface 250 of the front panel 14 rather than the front surface 66. The trim member 244 may be utilized to conceal the engagements between the deflector assembly 50 and the front panel 14. The trim member 244 may have snap features 254, which are configured to extend through the access opening 20 and engage mating features defined on the front panel 14 or the deflector assembly 50 to retain the trim member 244 in position. The trim member 244 extends adjacent to the access opening 20 and is configured to conceal engagements between the deflector assembly 50 on the front panel 14 without substantially impeding access to the drum 40.

Figure 39:
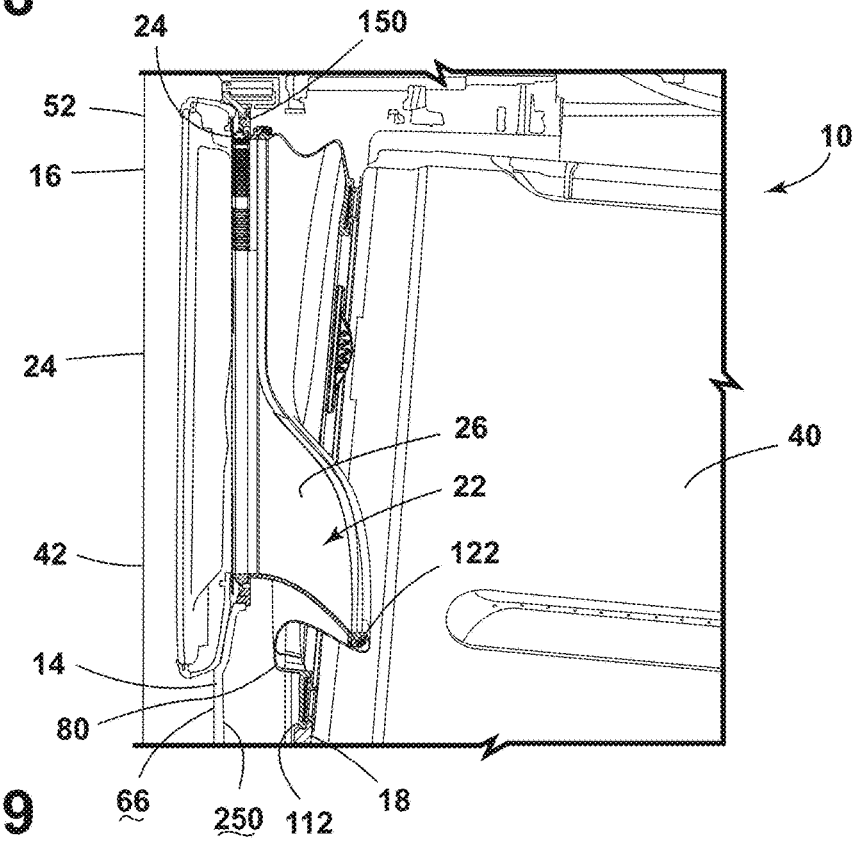
FIG. 39 is a partial cross-sectional view of a laundry appliance with a deflector assembly, according to the present disclosure.

With reference to FIG. 39, the deflector assembly 50 may be coupled to both the front surface 66 and the interior surface 250 of the front panel 14. In such examples, the front plate 52 is configured to be disposed adjacent to or abut the front surface 66 of the front panel 14 about the access opening 20. Further, the support feature 150 coupled to the rim 24 is configured to extend and engage the interior surface 250 of the front panel 14. This configuration provides a receiving area between the front plate 52 and the inner plate 200 to receive an edge of the front panel 14 that defines the access opening 20, which may be advantageous for coupling the deflector assembly 50 to the front panel 14. This configuration may be advantageous for retaining the deflector 22 as a stationary structure while allowing the bellows 28 to move.

Referring again to FIGS. 3-39, the various configurations of the deflector assembly 50 may be coupled to the laundry appliance 10 in each of the various manners described herein without departing from the teachings herein. In this way, each configuration of the deflector assembly 50 may be coupled to the front surface 66 of the front panel 14, to the interior surface of the front panel 14, or both. Generally, the support feature 150 may be utilized in configurations where the bellows 28 is coupled to the chute 26 and not directly coupled to the rim 24, to provide space for the support feature 150. Further, each configuration of the deflector assembly 50 utilizes the stationary deflector 22 and the deformable bellows 28 that is coupled to, molded, or otherwise attached to the deflector 22 with the deflector 22 disposed between the bellows 28 and the front panel 14.

Referring to FIGS. 1-39, the deflector assembly 50 includes the rigid deflector 22 coupled with the elastomeric, deformable bellows 28, forming an integrated component to be installed in the laundry appliance 10. The bellows 28 extends between the tub 18 and the deflector 22 rather than the conventional attachment between a bellows assembly and the front panel 14. The configuration of the insert 54 and the chute 26 affects the shape of the bellows 28. The bellows 28 defines the U-shaped primary fold 80, which allows for a predefined amount of movement of the tub 18 in all directions and promotes the fluid flow along the inner surface 92 of the bellows 28 and drainage into the tub 18. The use of the deflector 22 reduces a distance the bellows 28 extends, which reduces the material utilized if constructing the bellows 28 and, thereby, provides a more efficient manufacturing process. Accordingly, coupling the bellows 28 to the deflector 22 reduces the distance the bellows 28 extends, thereby reducing the surface area of the bellows 28 while allowing movement of the tub 18. Moreover, the shapes of the bellows 28 described herein are when the laundry appliance 10 is in an off or inactive state, such that there is no or minimal tub 18 movement. The shape changes slightly as the bellows 28 deform in response to movement of the tub 18.

The deflector 22 is a stationary component coupled with the front panel 14 and the bellows 28 is configured to deform and move. The deflector 22 and the bellows 28 are coupled together to form the deflector assembly 50 outside of the laundry appliance 10 and then installed as a single component into the laundry appliance 10. The deflector assembly 50 has direct attachments between the deflector 22 and the front panel 14, as well as between the bellows 28 in the tub 18, but generally not between the bellows 28 and the front panel 14.

Further, the rim 24, the trim member 244, and/or the door 42 may have a seal configured to form a watertight seal around the front opening 16 when the door 42 is in the closed position. The seal may extend along the rim 24 and/or the trim member 244 and be configured to be compressed against an interior surface of the door 42 when the door 42 is closed. Additionally or alternatively, the door 42 may include the seal on the interior surface thereof, and the seal is configured to compress against the rim 24 and/or the trim member 244 to form the watertight seal. The seal or seals are configured to seal the interior of the laundry appliance 10 when the door 42 is in the closed position to provide a fully sealed system during laundry cycles. Further, each of the configurations of the deflector assembly 50 disclosed herein may be utilized with the rotating type of door 42 and/or the sliding type of door 42.

Use of the present device provides a variety of advantages. For example, the deflector assembly 50 is configured to protect the bellows 28 by deflecting items away from the bellows 28. Additionally, the deflector assembly 50 forms a single or combined component having the rigid deflector 22 and the elastomeric bellows 28. Further, the bellows 28 extends between the deflector 22 and the tub 18, reducing materials used for constructing the bellows 28 and providing a more efficient manufacturing process. Moreover, the deflector assembly 50 is coupled to the cabinet 12 via attachments between the deflector 22 and the front panel 14 with no direct mechanical connection between the bellows 28 and the front panel 14. In this way, the deflector 22 is disposed between the front panel 14 on the bellows 28. Additionally, the deflector assembly 50 can be formed in a co-molding process. Also, the use of the deflector 22 changes the shape of the bellows 28 by reducing the distance between the inner and outer edges of the bellows 28, forming the U-shape, which promotes fluid flowing off the inner surface 92 of the bellows 28 and into the tub 18 and provides a substantially self-draining bellows 28. Further, the U-shape, particularly at the 6 o'clock position 86 of the bellows 28, minimizes entrapment of fluid and items on the bellows 28. Additional benefits or advantages may be realized and/or achieved.

The device disclosed herein is further summarized in the following paragraphs and is further characterized by combinations of any and all of the various aspects described therein.

According to at least one aspect of the present disclosure, a laundry appliance includes a cabinet with a front panel defining a front opening. A tub is disposed within the cabinet and has an access opening. The access opening is aligned with the front opening. A deflector has a rim and a chute. The rim is coupled to the front panel and extends along the front opening. The chute extends from the rim and toward the tub. A bellows is coupled to the deflector and the tub. The bellows extends along an inner edge of the rim and an interior edge of the chute and along the access opening of the tub. The deflector is disposed between the bellows and the front panel.

According to another aspect, a bellows defines a U-shape between a deflector and a tub.

According to yet another aspect, a bellows extends along an upper surface of a chute proximate an interior edge thereof.

According to another aspect of the present disclosure, a laundry appliance includes a front panel defining a front opening and a tub disposed adjacent to the front panel. The tub defines an access opening. A deflector assembly extends between the front panel and the tub. The deflector assembly includes a deflector having a rim coupled to a front surface of the front panel and a chute extending from the rim toward the tub and a bellows coupled to an innermost edge of the deflector. The bellows extends between the deflector to the tub. The deflector is disposed between the bellows and the front panel.

According to still another aspect, a bellows defines a receiving space for a chute of a deflector.

According to another aspect, a bellows extends along an upper surface of a chute proximate an interior edge of the chute.

According to yet another aspect of the present disclosure, a deflector assembly includes a rim having a front plate. The rim has an insert extending along an upper portion of the rim. A chute extends from a lower portion of the rim. A bellows is coupled to the upper portion of the rim and at least one of the lower portion of the rim under the chute and an interior edge of the chute.

According to another aspect, an insert extends from a front plate to a chute along a lower portion of a rim.

According to an aspect of the present disclosure, a laundry appliance includes a cabinet with a front panel that defines a front opening. A tub is disposed within the cabinet and defines an access opening. The access opening is aligned with the front opening. A deflector includes a rim coupled to the front panel. The rim extends along the front opening. A chute is coupled to the rim. The chute extends from a lower portion of the rim and toward the tub. A bellows has a deflector-side edge coupled to the deflector and a tub-side edge coupled to the tub. The deflector-side edge of the bellows is coupled to an inner edge of the rim and an interior edge of the chute. The tub-side edge of the bellows is coupled to a lip defining the access opening of the tub. The deflector is disposed between the bellows and the front panel.

According to an aspect of the present disclosure, a bellows defines a U-shaped primary fold between a deflector and a tub to form an inner surface of the bellows to direct fluid flow.

According to an aspect of the present disclosure, a U-shaped primary fold extends proximate to a lower surface of a chute. The U-shaped primary fold adjacent to the chute is spaced from an interior surface of a front panel.

According to an aspect of the present disclosure, a rim includes a front plate coupled to a front panel and an insert extending from the front plate. The insert extends at an oblique angle from the front plate and toward a tub.

According to an aspect of the present disclosure, a bellows forms at least a portion of an upper surface of a chute proximate to an interior edge.

According to an aspect of the present disclosure, a trim member is coupled to a front surface of a front panel and extends along a front opening.

According to an aspect of the present disclosure, a tub-side edge of a bellows defines a receiving portion that engages a lip of a tub. The bellows defines a wing adjacent to the receiving portion.

According to another aspect of the present disclosure, a laundry appliance includes a front panel that defines a front opening. A tub is disposed adjacent to the front panel. The tub defines an access opening. A deflector assembly extends between the front panel and the tub. The deflector assembly includes a deflector having a rim coupled to the front panel and a chute extending from the rim toward the tub. The deflector defines a deflector opening. A bellows is coupled to an innermost edge of the deflector and extends about the deflector opening. The bellows extends from the deflector to the tub. The deflector is disposed between the bellows and the front panel.

According to an aspect of the present disclosure, a bellows is coupled to a lower portion of a rim. The bellows defines a receiving space between the rim and an innermost edge to receive a chute of a deflector.

According to an aspect of the present disclosure, a bellows extends along an upper surface of a chute.

According to an aspect of the present disclosure, a bellows defines wings extending toward one another. The wings are defined adjacent to a receiving portion of the bellows that engages a tub.

According to an aspect of the present disclosure, a bellows extends along an entirety of an innermost edge of a deflector and defines a primary fold between the innermost edge of the deflector and the tub. The primary fold being defined between a rim and a tub at an upper portion of the deflector and between the chute and the tub at a lower portion of the deflector.

a bellows defines a primary fold between a deflector and a tub. The primary fold defined between a rim and the tub has a different configuration than the primary fold defined between a chute and the tub.

According to an aspect of the present disclosure, a bellows defines a secondary fold adjacent to a primary fold. The primary fold and the secondary fold open in opposing directions.

According to an aspect of the present disclosure, an innermost edge of a deflector defines a groove. According to an aspect of the present disclosure, a rim includes a front plate coupled to a front panel and an insert extending from the rim toward a tub. A bellows is coupled to the insert at an upper portion of the rim.

According to another aspect of the present disclosure, a deflector assembly includes a deflector that defines a deflector opening. The deflector includes a rim with a front plate and an insert that extends from the front plate. The insert extends along an upper portion of the rim about at least a portion of the deflector opening. A chute extends along a lower portion of the rim. A bellows is coupled to the upper portion of the rim and at least one of the lower portion of the rim under the chute and an interior edge of the chute.

According to an aspect of the present disclosure, a bellows is coupled to a lower portion of a rim and an interior edge of a chute. The bellows defines a receiving space between the rim and the interior edge of the chute to receive the chute.

According to an aspect of the present disclosure, a support feature is coupled to an inner surface of a rim. The support feature extends along an upper portion of the rim and along a lower portion of the rim below a chute.

According to an aspect of the present disclosure, a deflector defines projections spaced along an innermost edge thereof.

According to an aspect of the present disclosure, a bellows defines a U-shaped primary fold proximate to a lower surface of a chute. The bellows defines a secondary fold extending from an upper surface of the chute, around projections, and adjacent to the lower surface of the chute.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes, and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A laundry appliance, comprising:

a cabinet including a front panel defining a front opening;

a tub disposed within the cabinet and defining an access opening, wherein the access opening is aligned with the front opening;

a deflector including:

a rim coupled to the front panel, wherein the rim extends along the front opening; and a chute coupled to the rim, wherein the chute extends from a lower portion of the rim and toward the tub; and a bellows having a deflector-side edge coupled to the deflector and a tub-side edge coupled to the tub, wherein the bellows extends along a bottom surface of the deflector with the deflector-side edge of the bellows is-coupled to an inner edge of the rim at a front and an interior edge of the chute, and wherein the tub-side edge of the bellows is coupled to a lip defining the access opening of the tub, and further wherein the deflector is disposed between the bellows and the front panel.

2. The laundry appliance of claim 1, wherein the bellows defines a U-shaped primary fold between the deflector and the tub to form an inner surface of the bellows to direct fluid flow.

3. The laundry appliance of claim 2, wherein the U-shaped primary fold extends proximate to a lower surface of the chute, and wherein the U-shaped primary fold adjacent to the chute is spaced from an interior surface of the front panel.

4. The laundry appliance of claim 1, wherein the rim includes a front plate coupled to the front panel and an insert extending from the front plate, and wherein the insert extends at an oblique angle from the front plate and toward the tub.

5. The laundry appliance of claim 1, wherein the bellows forms at least a portion of an upper surface of the chute proximate to the interior edge.

6. The laundry appliance of claim 1, further comprising:

a trim member coupled to a front surface of the front panel and extending along the front opening.

7. The laundry appliance of claim 1, wherein the bellows is a single component with the bottom surface of the rim and the chute.

8. A laundry appliance, comprising:

a front panel defining a front opening;

a tub disposed adjacent to the front panel, wherein the tub defines an access opening; and a deflector assembly extending between the front panel and the tub, wherein the deflector assembly includes:

a deflector having a rim coupled to the front panel and a chute extending from the rim toward the tub, wherein the deflector defines a deflector opening; and a bellows coupled to an innermost edge of the deflector and extending about the deflector opening, wherein the bellows extends from the deflector to the tub, and wherein the deflector is disposed between the bellows and the front panel, and further wherein the bellows is a single component with a bottom surface of the rim and coupled with an inner edge of the chute.

9. The laundry appliance of claim 8, wherein the bellows is coupled to a lower portion of the rim, and wherein the bellows defines a receiving space between the rim and the innermost edge to receive the chute of the deflector.

10. The laundry appliance of claim 8, wherein the bellows extends along an upper surface of the chute.

11. The laundry appliance of claim 8, wherein the bellows extends along an entirety of the innermost edge of the deflector and defines a primary fold between the innermost edge of the deflector and the tub, the primary fold being defined between the rim and the tub at an upper portion of the deflector and between the chute and the tub at a lower portion of the deflector, and wherein the primary fold defined between the rim and the tub has a different configuration than the primary fold defined between the chute and the tub.

12. The laundry appliance of claim 11, wherein the bellows defines a secondary fold adjacent to the primary fold, and wherein the primary fold and the secondary fold open in opposing directions.

13. The laundry appliance of claim 8, wherein the rim includes a front plate coupled to the front panel and an insert extending from the rim toward the tub, and wherein the bellows is coupled to the insert at an upper portion of the rim.

14. The laundry appliance of claim 8, wherein the bellows has a first thickness proximate to the rim, a second thickness proximate to a higher portion of the chute, and a third thickness along a lower portion of the chute, the second thickness is greater than the first thickness and the third thickness is greater than the second thickness for supporting the chute.

15. The laundry appliance of claim 8, wherein the bellows is a single component with the chute.

16. A deflector assembly, comprising:

a deflector defining a deflector opening, wherein the deflector includes:

a rim including a front plate and an insert extending from the front plate, wherein the insert extends along an upper portion of the rim about at least a portion of the deflector opening; and a chute extending along a lower portion of the rim; and a bellows coupled to the upper portion of the rim and a bottom surface of the deflector from the lower portion of the rim to an interior edge of the chute.

17. The deflector assembly of claim 16, wherein the bellows defines a receiving space between the rim and the interior edge of the chute to receive the chute.

18. The deflector assembly of claim 16, wherein the bellows is a single component with the rim and the chute.

19. The deflector assembly of claim 16, wherein the bellows has a first thickness proximate to the rim, a second thickness proximate to a higher portion of the chute, and a third thickness along a lower portion of the chute, the second thickness is greater than the first thickness and the third thickness is greater than the second thickness for supporting the duckbill extension of the chute.

20. The deflector assembly of claim 16, wherein the bellows extends along an upper surface of the chute.

* * * * *